US005720196A

United States Patent [19]

Tamai et al.

[11] Patent Number: 5,720,196

[45] Date of Patent: Feb. 24, 1998

[54] HOT-ROLLING METHOD OF STEEL PIECE JOINT DURING CONTINUOUS HOT-ROLLING

[75] Inventors: Yoshikiyo Tamai; Katsuhiro Takebayashi; Toshio Imae; Hideyuki Nikaido; Kunio Isobe, all of Chiba, Japan

[73] Assignee: Kawasaki Steel Corporation, Kobe, Japan

[21] Appl. No.: 626,206

[22] Filed: Mar. 29, 1996

[30] Foreign Application Priority Data

Apr. 18, 1995 [JP] Japan ..... 7-092233

[51] Int. Cl.[6] ..... B21B 29/00

[52] U.S. Cl. ..... 72/241.8; 72/203; 72/88; 72/10.4; 72/10.7

[58] Field of Search ..... 72/241.2, 241.4, 72/241.8, 203, 205, 8.7, 8.8, 8.9, 9.1, 9.2, 9.3, 10.4, 10.7, 11.3, 11.5–12.1, 12.8, 13.4, 14.1, 14.4

[56] References Cited

U.S. PATENT DOCUMENTS

| | | | |
|---|---|---|---|
| 3,584,853 | 6/1971 | Munson | 72/12.8 |
| 4,711,114 | 12/1987 | Rohde et al. | 72/203 |
| 5,037,024 | 8/1991 | Minato et al. | 72/203 |
| 5,404,738 | 4/1995 | Sekiguchi | 72/205 |
| 5,531,089 | 7/1996 | Nikaido et al. | 73/241.8 |
| 5,560,236 | 10/1996 | Onda et al. | 72/11.8 |

FOREIGN PATENT DOCUMENTS

| | | | |
|---|---|---|---|
| 0378131 | 1/1990 | European Pat. Off. . | |
| 03901140 | 3/1990 | European Pat. Off. . | |
| 0390140 | 3/1990 | European Pat. Off. . | |
| 0566986 | 4/1993 | European Pat. Off. . | |
| 0582980 | 8/1993 | European Pat. Off. . | |
| 0628361 | 5/1994 | European Pat. Off. . | |
| 4136013 | 5/1992 | Germany | 72/11.7 |
| 60-227913 | 4/1986 | Japan . | |
| 61-222623 | 10/1986 | Japan | 72/11.8 |
| 62-254913 | 11/1987 | Japan . | |
| 63-84708 | 4/1988 | Japan | 72/241.8 |
| 2127904 | 5/1990 | Japan . | |
| 4337029 | 11/1992 | Japan . | |
| 4351213 | 12/1992 | Japan . | |
| 5156361 | 6/1993 | Japan . | |
| 52-08204 | 8/1993 | Japan | 72/241.8 |
| 6033141 | 2/1994 | Japan . | |
| 6154821 | 6/1994 | Japan . | |
| 62-69821 | 9/1994 | Japan | 72/241.8 |
| 6182413 | 10/1994 | Japan . | |
| 7024512 | 1/1995 | Japan . | |
| 8099107 | 4/1996 | Japan . | |

*Primary Examiner*—Lowell A. Larson
*Assistant Examiner*—Ed Tolan
*Attorney, Agent, or Firm*—Dvorak & Orum

[57] ABSTRACT

A method for continuously hot-rolling steel pieces, includes butt-joining the rear end of the preceding steel piece and the leading end of the succeeding steel piece, then finish-rolling the butt-joined steel pieces by supplying a continuous hot rolling facility provided with a plurality of stands having a bending function of a work roll. The method involves estimating the variation of the rolling force occurring during rolling the joint of the steel pieces at the non-stationary zone caused by said joint, calculating the changing bending force of the work roll during rolling the joint of the steel pieces from the estimated variation of the rolling force, and determining the pattern for changing the bending force taking account of said changing force, and rolling the joint of the steel pieces by regulating the bending force in response to said pattern over at least one stand, while tracking down the joint of the steel piece immediately after joining.

19 Claims, 22 Drawing Sheets

HOT-ROLLING METHOD OF STEEL PIECE JOINT DURING CONTINUOUS HOT-ROLLING

BACKGROUND OF THE INVENTION

1. Field of the Invention

This invention relates to methods for continuous hot-rolling suitable for continuously rolling a few to a few dozen pieces of steel billet, slab and the like. In particular, the present invention is intended to provide stable continuous hot-rolling processes that do not fracture the sheet during rolling due to variable sheet shape formed on rolling the joint of the steel pieces.

2. Description of the Related Art

In conventional hot-rolling lines, steel pieces to be rolled have been heated, rough-rolled, and finish-rolled one by one to provide hot-rolled sheet having a given thickness of the sheet. In such rolling process, the shutdowns due to biting failures at the leading end of a metal piece inevitably occur during the finish rolling. There is a further disadvantage, i.e., the decreased yield due to poor profile at the leading and rear ends of the rolled material.

Recently, continuous hot-rolling processes have been employed before the finish rolling. The rear end of a preceding steel piece is joined to the leading end of the succeeding steel piece and the joined steel pieces are continuously supplied to the rot-rolling line. Examples of such art include Japanese Laid-Open Patent Nos. 6-15,317, 60-227,913, and 2-127,904.

The continuous hot-rolling processes still have some problems to be solved for the practical use, because of the following reasons: Before the steel pieces are joined together, the ends to be joined are preliminarily heated. Irregular temperature distribution at the heated portion causes load fluctuation during rolling, resulting in poor sheet shape due to the fluctuated deflection of the rollers. Since the poor sheet shape varies the unit tension distribution in the width direction to concentrate stretching force at the joint edges, an unacceptable shutdown of the line occurs due to the sheet rupture during the rolling.

Although feed-back control processes using the roll bender of the rolling mill have been used to prevent the shape fluctuation at the joint, it is still unsatisfactory due to the delayed response of the roll bender. As a means to solve such drawbacks, Japanese Laid-Open Patent No. 2-127,904 discloses art attempting to prevent the sheet rupture in which the joint of the sheet is rolled to provide a thickness greater than the standard thickness of the sheet. In this prior art, the weld sections of the original steel sheets are precisely tracked down and the thickness of the weld section is controlled so as to be greater than the standard thickness of the sheet during rolling by a cold-rolling mill. It is purported that such technology enables the decrease in the off-gauge and the prevented sheet rupture.

Further this rolling method is characterized in that the weld section of the original steel sheet is precisely tracked, and the rolling speed of the first stand is controlled during cold-rolling the weld section so that the thickness of the weld section is greater than the standard thickness of the sheet. Since the thickness change can be carried out at a short section in the rolling direction in the cold rolling, the irregularity of the sheet shape does not occur due to the thickness change at the weld section. In contrast, in the hot rolling, because the rolling speed is high and the region in which the thickness of the joint decreases ranges in the wide rolling direction at the rear stand, the irregularity of the sheet shape occurs due to the load variation caused by the thickness change.

Japanese Laid-Open Patent No. 60-227913 discloses a continuous rolling process of the joined coil while changing the thickness of the sheet during the run. The thicknesses before/after the thickness changing point are measured by the thickness meter provided at the inlet side of the mill, and the roll gap and rolling speed to be changed at the thickness changing point are determined on the basis of observed thickness of the sheet during rolling. However, the rupture at the joint due to the shape change can not be prevented by such technology.

SUMMARY OF THE INVENTION

It is an object of the present invention to provide a novel continuous finish hot rolling carried out after butt-joining the rear end of the preceding sheet with the leading end of the succeeding sheet. The rolling process proceeds with stability by preventing the sheet rupture and by improving the sheet passing through property due to the shape change at the joint.

The present invention is intended to provide a method for continuously hot-rolling steel pieces. The method includes butt-joining the rear end of the preceding steel piece and the leading end of the succeeding steel piece, and then finish-rolling the butt-joined steel pieces by supplying a continuous hot rolling facility provided with a plurality of stands having a bending function of a work roll; and the method is characterized by estimating the variation of the rolling force occurring during rolling of the joint of the steel pieces at the non-stationary zone caused by the joint; calculating the changing bending force of the work roll during rolling the joint of the steel pieces from the estimated variation of the rolling force, and determining the pattern for changing the bending force taking account of the changing force; and rolling the joint of the steel pieces by affecting the bending force in response to the pattern over at least one stand, while tracking the joint of the steel piece immediately after joining.

The pattern for changing the bending force is preferably determined so that the actual forcing time of the bending force in response to the force variation at the joint of the steel pieces becomes $2T_i$ or more, wherein $T_i$ is the difference between calculated time and observed time as the tracking error time when the joint of the steel pieces reaches the i-th stand.

The pattern for changing the bending force is preferably determined by using the maximum tracking error time $T_i$ among the differences between the calculated time and observed time when the method is carried out at a plurality of stands.

One effective method for achieving the objects is a method for continuously hot-rolling steel pieces in which the rear end of the preceding steel piece and the leading end of the succeeding steel pieces are joined to each other, and then supplied to the rolling device provided with a plurality of stands. The targeted thickness of the joint of the steel pieces at the delivery side of the mill is set so as to be thicker than the targeted thickness of the stationary zones of the preceding and succeeding steel pieces at the delivery side of the mill of at least one stand.

The present invention is further intended to provide a process for rolling the joint of steel pieces in a method for continuously hot-rolling steel pieces, wherein the method uses a means for calculating on-line or off-line the changing force of a work roll bender controlled by the rolling force variation caused by increasing the thickness of the joint and its neighboring sections and the shape variation of the sheet caused by the force variation; and the bending force is changed at the thickness-increased portion of the joint and its neighboring sections compared with the stationary zone, in response to changing bending force.

In the method set for above, the roll cross angle in a roll crossed rolling mill is changed during rolling before changing the bending force at a predetermined section along the joint and its neighboring sections, and the bending force is set at a predetermined value by changing the bending force in synchronism with the change of the cross angle so as to avoid the shape change of the rolled material at the starting and end points of the change of the cross angle.

DETAILED DESCRIPTION OF THE PREFERRED EMBODIMENTS

Some methods are proposed for joining the steel pieces for the purpose of continuously hot-rolling the steel pieces. Typical examples among such methods include butt-joining the rear end of the preceding steel piece and the leading end of the succeeding steel piece by induction heating, and butt-welding the rear end of the preceding steel piece and the leading end of the succeeding steel piece. It is thought that these joining methods are the most prospective since the steel pieces can be joined to each other in a relatively short time.

Figure 1:
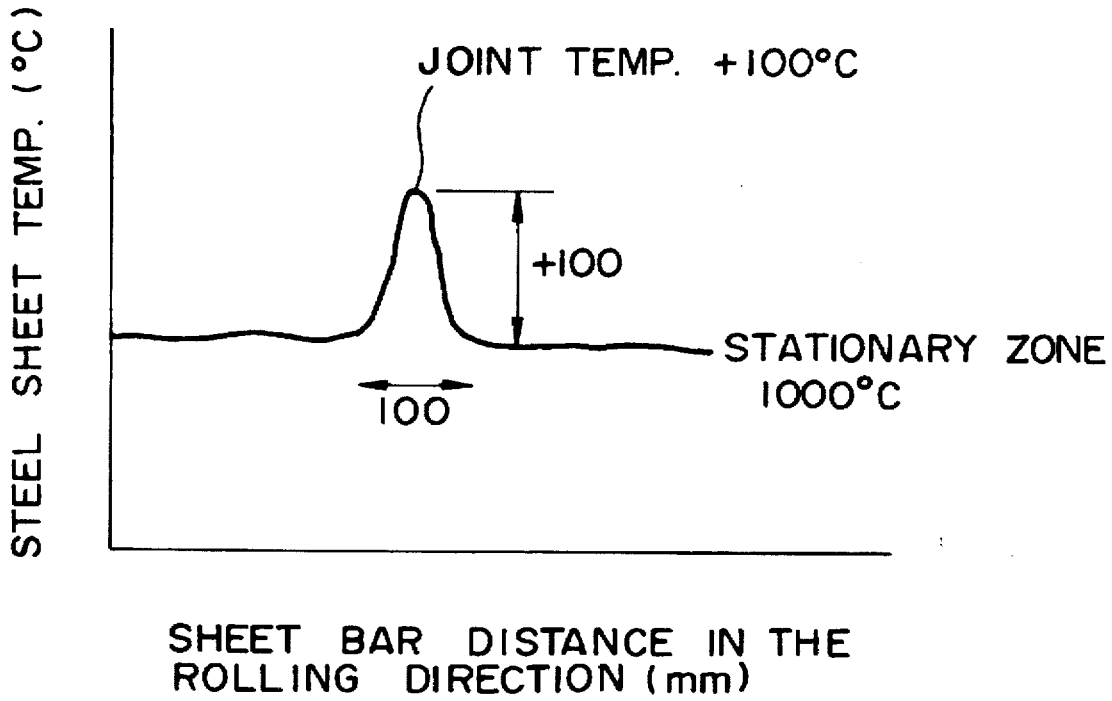
FIG. 1 is a graph illustrating the temperature difference between the joint and the stationary zone of the steel piece.
Figure 2A:
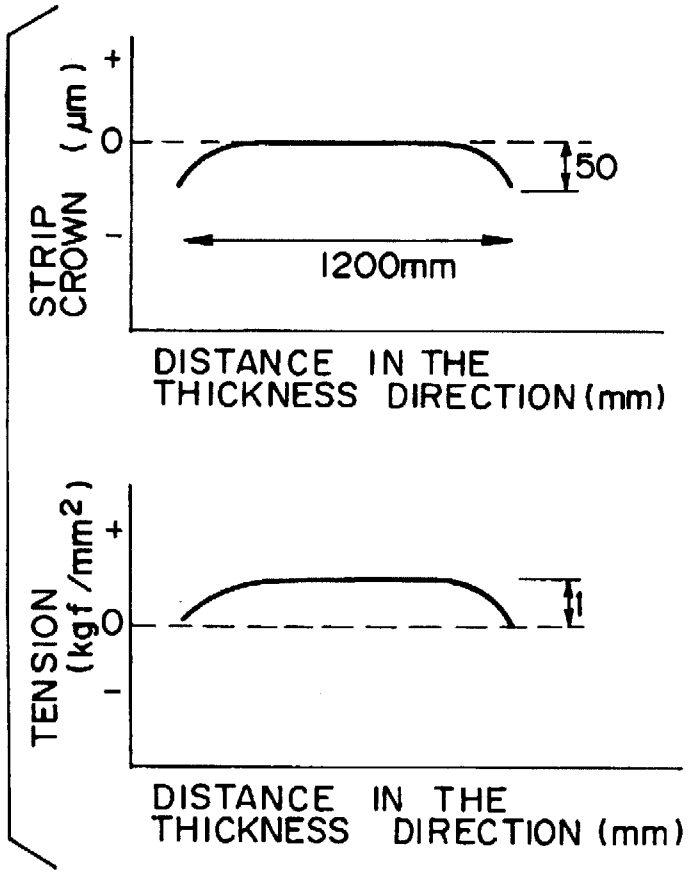
FIGS. 2A and 2B are graphs illustrating the statuses of the strip crown and tension at the stationary zone and the joint of the steel piece, respectively.
Figure 2B:
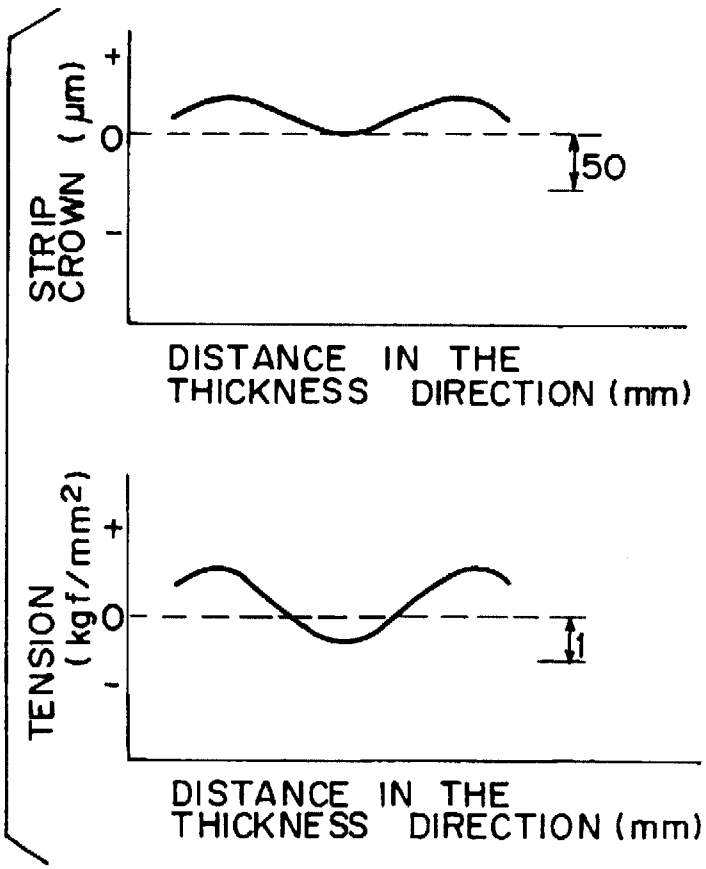

However, when the steel pieces are joined in such methods, a temperature difference will occur between the joint of the steel pieces and other zones (hereinafter called "stationary zone") as shown in FIG. 1. As a result, since the joint of the steel piece has a decreased flow stress or rolling force due to a temperature higher than at the stationary zone, the strip crown of the joint decreases compared with the stationary zone, and both edge portions of the sheet have a smaller elongation rate compared with the central portion of the sheet. Therefore, the tension is created in the longitudinal direction of the sheet as shown in FIGS. 2A and 2B.

Further, the joint of the steel pieces has a relatively low strength compared with the stationary zone, and a residual unjointed portion, if one exists, causes a strain concentration during rolling as a notch. A crack which occurs at such portion propagates until there is a rupture of the joint. On the other hand, when the force increases at the joint, the sheet shape changes to an edge wave shape so the tension in the longitudinal direction acts at the central portion of the sheet width. If an unjointed portion exists at the center of the width, the crack from the unjointed portion also propagates until there is a rupture. Such phenomena will also be caused by other factors which vary the rolling force at the joint, such as a size variation formed during joining, other than the temperature difference during joining the steel pieces.

In the present invention, the temperature and width at the joint of the steel pieces are measured, the rolling force during rolling the joint is estimated based on the measured data (the estimation can be carried out by the same calculation as the usual finish rolling, or by the observed force variation during rolling of the joint in the same drafting schedule), the changing amount of the bending force at the joint is calculated from the estimated rolling force by using the following equation, and the pattern changing the bending force taking account of such changing amount is served to the rolling process:

$$\Delta PB=(\alpha/\beta)\Delta P \quad (1)$$

wherein, ΔP represents the rolling force variation, ΔPB represents the changing amount of the bending force, α represents the influence coefficient of the rolling force to the rolling mill deflection, and β represents the influence coefficient of the bending force to the rolling mill deflection. These coefficients are determined by the size and material of each section of the rolling mill, and can be estimated before rolling the steel pieces.

Figure 3A:
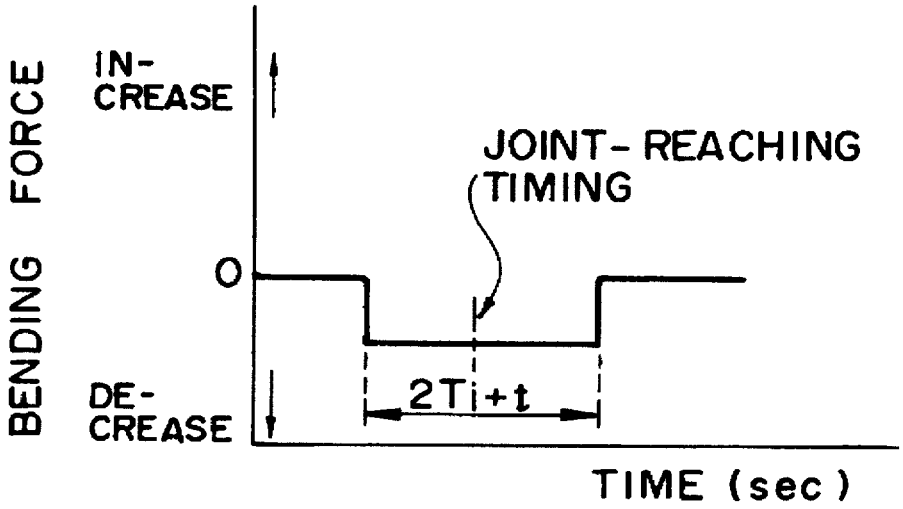
FIGS. 3A and 3B are graphs illustrating the patterns for changing the bending force.
Figure 3B:
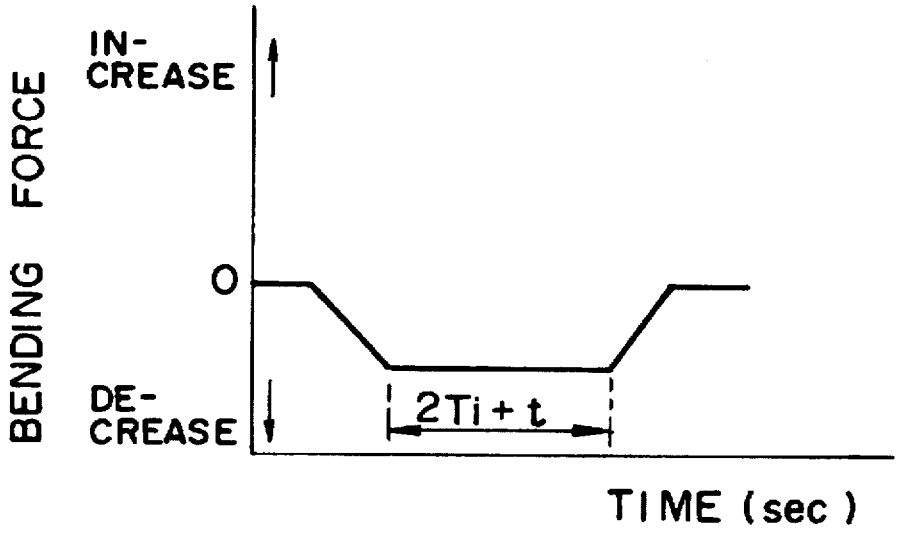

As the pattern used for changing the bending force during rolling the joint of the steel pieces, there is, for example, a rectangular pattern as shown in FIG. 3A or a trapezoid pattern as shown in FIG. 3B.

The arrival timing of the joint to each stand can be traced by using a measuring roll, or by any conventional tracking method, such as a position detector based on the transferring speed of the sheet material.

Then, as shown in FIGS. 3A and 3B, the bending force is changed with the timing at which the joint of the steel pieces reaches the middle point of the time for changing the bending force.

Figure 4:
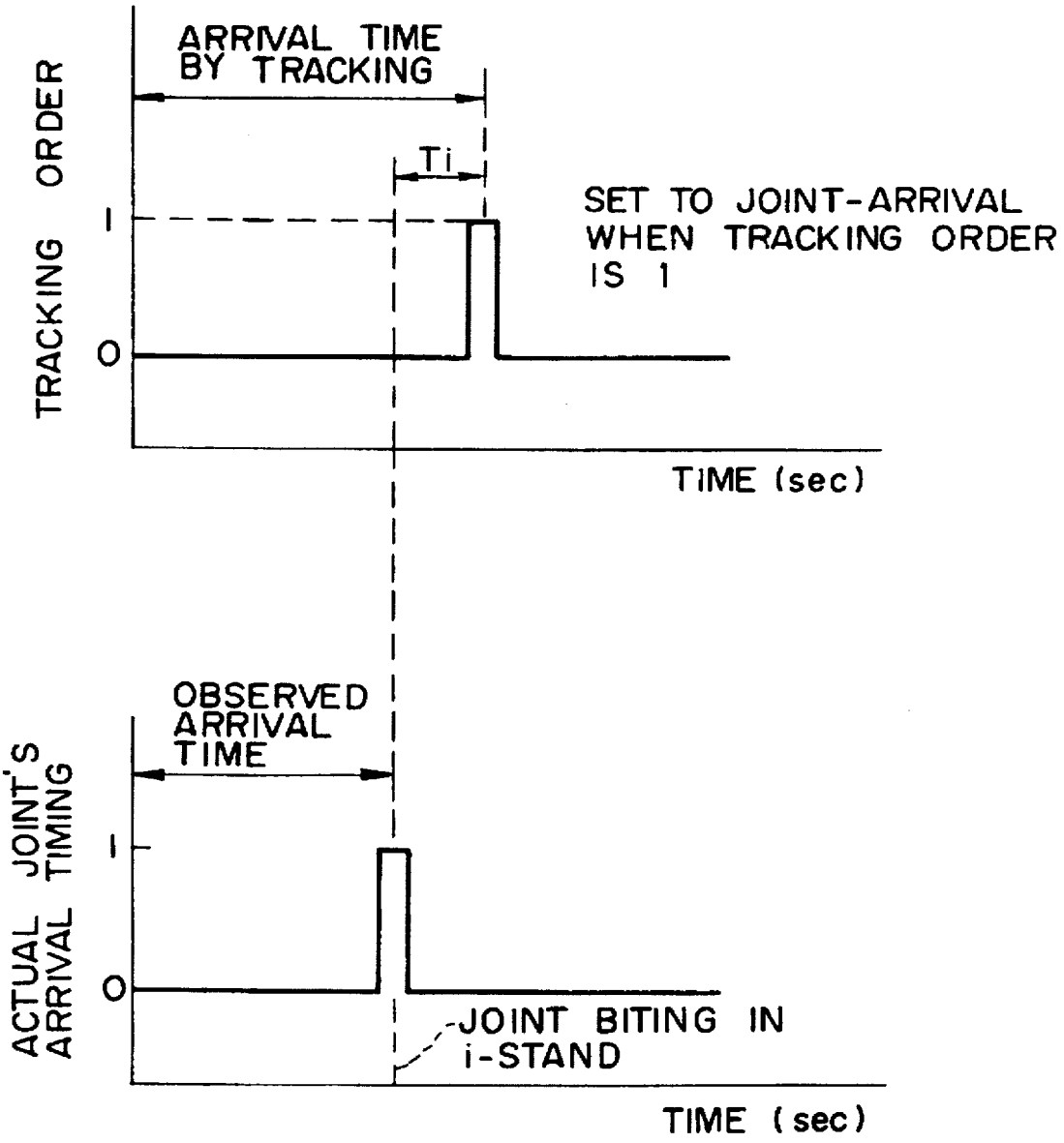
FIG. 4 is graphs illustrating the statuses of the arrival time of the joint and the tracking order at i-th stand.

When the difference occurs between the actual arrival time of the joint of the steel pieces to the stand and the arrival time due to tracking, the joint of the steel pieces is preferably rolled by using a more precise pattern taking account of such difference as the tracking error time $T_i$. The tracking error time $T_i$ may be determined from the difference between the arrival time of the joint calculated from the transferring speed of the steel pieces (tracking starts immediately after joining) and the actual arrival time of the joint as shown in FIG. 4.

When the bending force is changed at any portion other than the joint of the steel pieces due to tracking error and the like, the center wave occurs at the joint and thus tension occurs to break at both end portions of the joint as set forth above. In order to prevent such fracture, the changing time (ordered value) of the bending force is preferably set at $2T_i$. More preferably, the changing time may be set at $2T_i+t$ taking account of the response lag time t of the bending force.

When the steel pieces are rolled in accordance with the present invention, since the joint reaches each stand within the time that the bending force in response to the force variation during rolling of the joint is substantially outputted at each stand, a predetermined bending force can always be loaded at the joint of the steel pieces, without the deterioration of the shape nor a rupture of the sheet.

When such operation is carried out in a plurality of stands, the changing time can be determined in the manner set forth above by using the maximum error time $T_i$ among all error times, and the bending force at each of the other stands can be changed in synchronism with the maximum error time.

The pattern for changing the bending force is not limited to FIGS. 3A and 3B. When using a trapezoid pattern as shown in FIG. 3B, the changing time of the upper side of the trapezoid is preferably set at the $2T_i+t$. However, when there is sufficient time at both inclined sides of the trapezoid at which the bender can respond, it is not necessary to take into account such response lag time of the bender at the upper side of the trapezoid.

Figure 5:
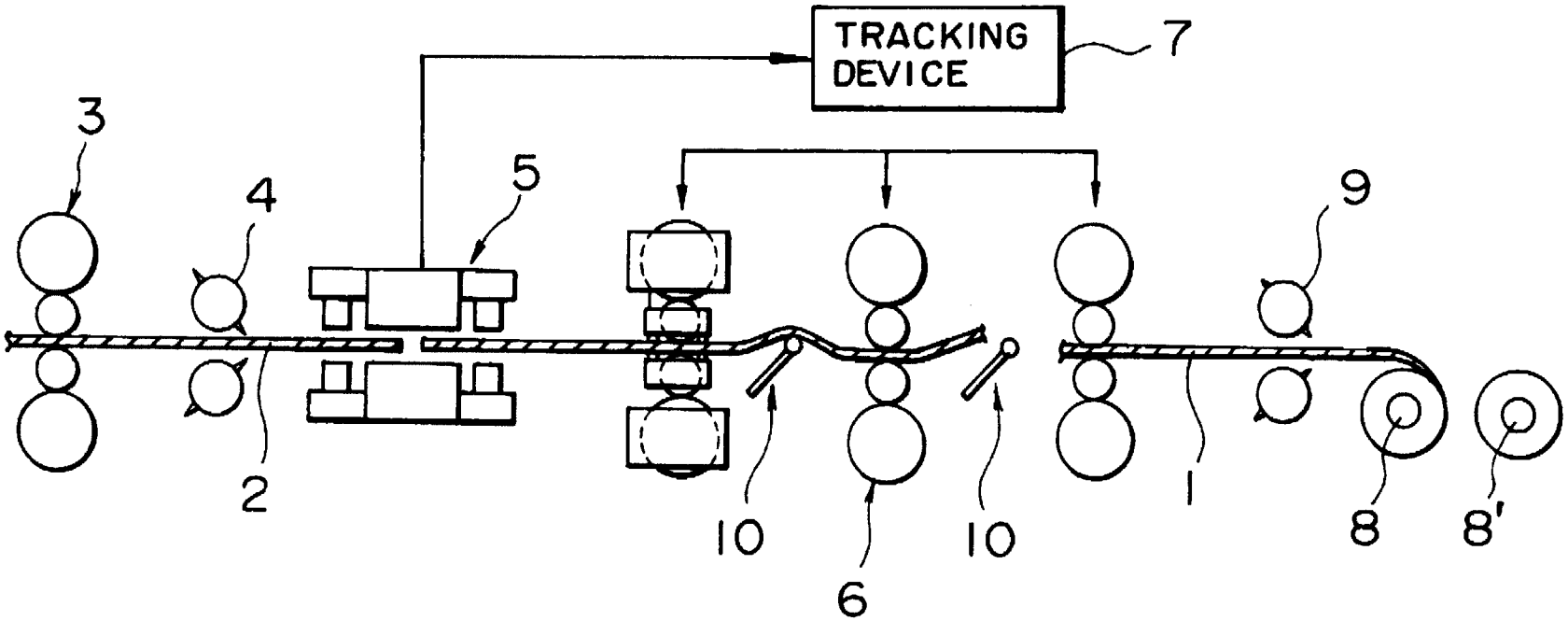
FIG. 5 is a block diagram illustrating the apparatus suitable for the use in accordance with the present invention.

FIG. 5 is an embodiment of the continuous hot, finish rolling facility suitable for the present invention, wherein 1 represents a preceding steel piece, 2 represents a succeeding steel piece, 3 represents a rough rolling mill, 4 represents a cutter for cutting the end of the steel piece to a given shape, 5 represents a joining device for heating and pressing the end of the cut steel piece, 6 represents a group of continuous rolling mills provided with a plurality of stands, 7 represents a tracking device for tracking the joint of the steel pieces, 8 and 8' represent coilers for coiling the sheet after rolling, 9 represents a cutter for cutting the sheet after rolling to a predetermined length, and 10 represents a looper.

Figure 18:
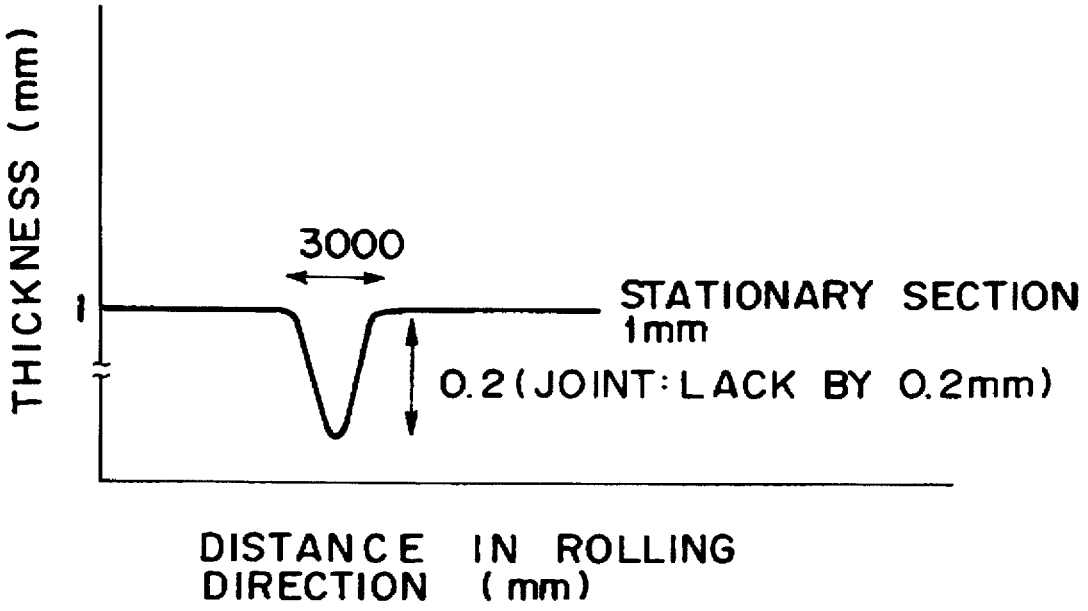
FIG. 18 is a graph illustrating an example of the thickness distribution in the rolling direction (of the F7 delivery side of the mill) near the joint.

When the rolling temperature portion is higher than the stationary zone, the flow stress is lower and the rolling force is decreased at the higher portion, and the thickness at the higher portion decreases compared with the stationary zone. As shown in FIG. 18, which is an example of the thickness distribution in the rolling direction near the joint after finish rolling, since the cross section of the joint decreases compared with the stationary zone, the unit tension at the joint increases. Further, since the temperature at the joint is high, the strength is lower than at the stationary zone. Thus, the increased unit tension at the joint significantly affects the rupture at the joint.

Accordingly, in the present invention, when the targeted thickness of the sheet at the delivery side of the mill is set $h_i$ac, and when there is the possibility of rupture between the i-th stand and (i+1)-th stand, the targeted thickness $h_1^{ad}$ of the joint at the delivery side of the mill of the i-th stand (standard stand) is determined to a thickness greater by a predetermined value than the targeted thickness $h_1^{ac}$ of the stationary zone at the delivery side of the mill.

The predetermined value set forth above at the standard stand is preferably determined so that the joint has a cross section (the product of the actual thickness and width of the sheet at the delivery side of the mill after rolling) so as to not rupture the joint due to the tension variation between the i-th stand and (i+1) stand caused by the variation of the temperature and material of the joint and the variation of the tension.

When the targeted thickness $hi_1^{ad}$ of the joint at the delivery side of the mill of the standard stand is set at a thickness greater by a predetermined value than the targeted thickness $h_1^{ac}$ of the stationary zone at the delivery side of the mill, and the roll gap is changed so that the thickness of the steel piece at the delivery side of the mill is the targeted thickness of the joint, the joint has a cross section not caused to be ruptured due to the tension variation between stands.

In the present invention, since the roll gap is changed so that the thickness of the joint of the steel piece at the delivery side of the mill becomes the targeted thickness of the joint at the delivery side of the mill, the tension variation can be suppressed between stands, and a rupture at the joint can be prevented.

The method for changing the roll gap will be explained.

Let us suppose that the rupture at the joint occurs, for example, between the 6th stand as the i-th stand and 7th stand as the (i+1)-th stand in a continuous hot rolling process using a finish roller mill having seven stands. A mode for changing the roll gap at the 6th stand will be explained with reference to FIG. 12.

One method for changing the roll gap is that the changing amount of the rolling reduction is calculated so that the thickness of the steel piece at the delivery side of the mill becomes the target thickness of the sheet at the delivery side of the mill and the position of the rolling reduction is changed in response to the calculation.

Figure 12:
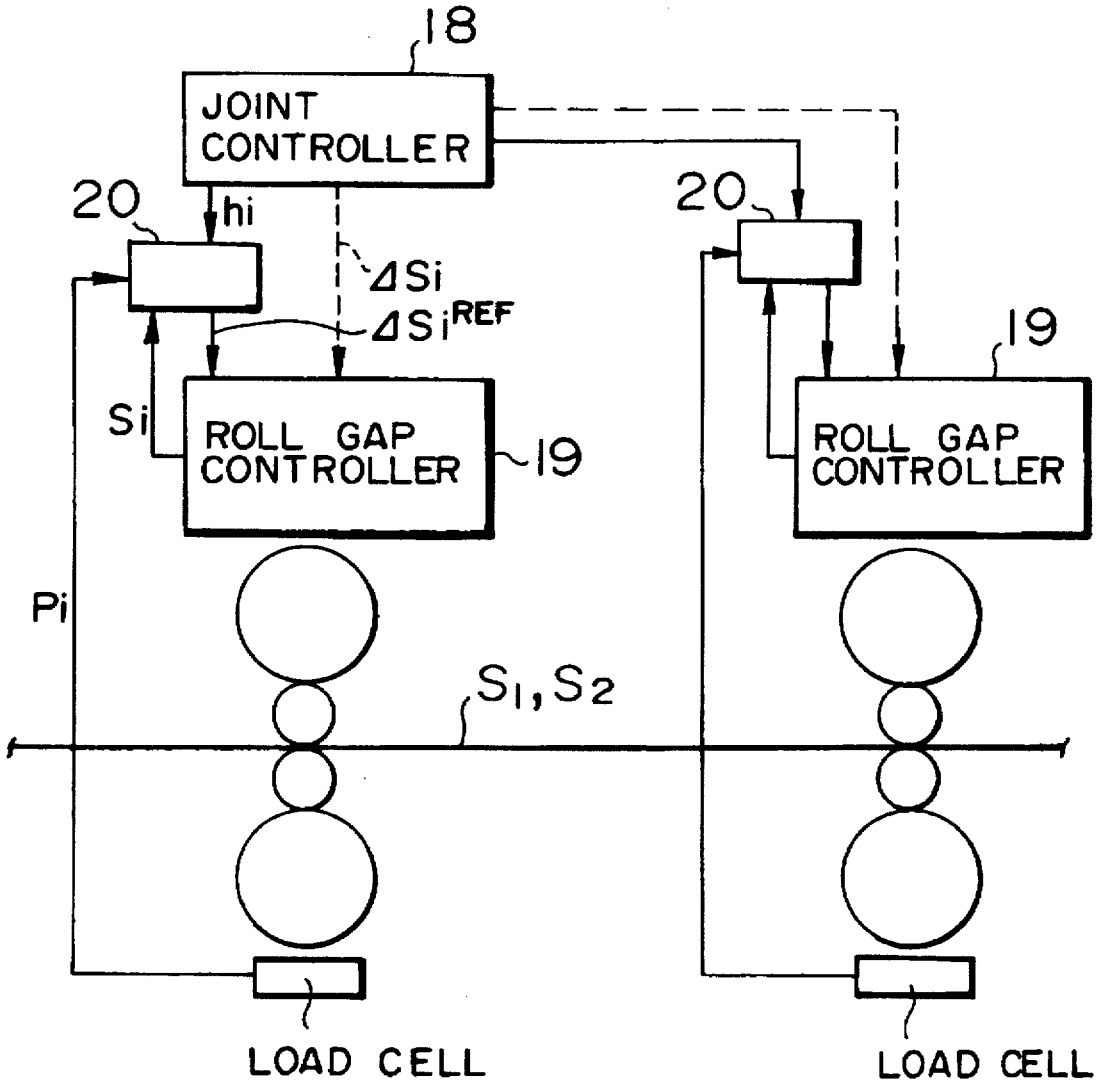
FIG. 12 is a diagram illustrating the rolling process in accordance with the present invention.

For example, a joint controller 18 in FIG. 12 calculates the changing amount $\Delta S_i$ of the roll gap based on the conventional rolling theory by the following equation. The thickness of the steel piece at the delivery side of the mill is changed from the targeted thickness of the sheet of the stationary zone to the targeted thickness $h_i^{ad}$ of the joint. The controller outputs such changing amount of $\Delta S_i$ of the roll gap while tracking the joint through a roll gap controller 19 according to the broken line in the figure, at a predetermined changing time before the joint reaches the stand:

$$\Delta S_i=\{(M_i+Q_i)/M_i\}\cdot\Delta h_i^a \quad (11)$$

$$\Delta h_i^a=h_i^{ad}-h_i^{ac} \quad (12)$$

wherein the suffix i represents the stand number, $M_i$ represents the mill modulus, and $Q_i$ represents the gradient of the plastic curve at the stationary zone of the steel piece, and $M_i$ and $Q_i$ are preliminarily calculated.

After the joint passes the 6th stand, the amount $-\Delta S_i$ having an opposite sign to the changing amount of the roll gap is outputted from the roll gap controller 19 at a predetermined changing time. The roll gap controller 19 changes the roll gap in response to the changing amount of the roll gap, and the thickness of the joint is controlled according to the targeted thickness of the sheet at the delivery side of the mill. The changing time is determined by the upper limit of the changing speed of the roll gap, the limit of the stable operation, and the like.

Another method for changing the roll gap is that the thickness of the sheet at the delivery side of the mill at the stand is detected with a gauge meter from the rolling force and actual roll gap. The roll gap of the stand is controlled so that the thickness of the sheet at the delivery aide of the mill agrees with the targeted thickness of the sheet. In this method, the thickness $h_i^a$ at the delivery side of the mill of the 6th stand is outputted from the joint controller 18 to a thickness controller 20 as shown in a solid line.

The thickness controller 20 calculates the gauge meter thickness of the sheet at the delivery side of the mill of the 6th stand (i stand) based on the actual rolling force $P_i$ and the roll gap when un-loaded $S_i$ by using the following gauge meter equation:

$$h_i^G=S_i+P_i/M_i \quad (13)$$

Then, the difference between the targeted thickness $h_i^a$ and the gauge meter thickness $h_i^G$ at the delivery side of the mill of the i-th stand is calculated, the proportional and integral (IP) operations for canceling the difference is performed, and the changing amount $\Delta S_i$ of the roll gap is outputted toward the roll gap controller 19. The roll gap controller 19 changes the roll gap in response to the changing amount $\Delta S_i$REF of the roll gap. The gauge meter thickness $h_i^G$ at the delivery side of the mill is controlled to the targeted thickness $h_i^a$ at the delivery side of the mill thereby.

The joint controller 18 tracks the joint, changes the targeted thickness $h_i^a$ to the targeted thickness of the joint at the delivery side of the mill from the targeted thickness of the stationary zone at the delivery side of the mill at a predetermined changing time, and again changes the targeted thickness $h_i^a$ to the targeted thickness of the stationary zone at the delivery side of the mill from the targeted thickness of the joint at the delivery side of the mill at a predetermined changing time after the joint passes the stand. The changing time is determined by the upper limit of the changing speed of the roll gap and the limit of the stable operation.

When there is the possibility of a joint rupture between the 6th and 7th stands as set forth above, the change of the roll gap of the 6th stand in such a manner can prevent the rupture of the sheet.

When the 6th stand is set at the standard stand position and the roll gap is changed at only this stand as the above-mentioned embodiment, it is preferable that the targeted thickness of the joint at the delivery side of the mill is expediently changed at the 5th stand, because of the tension changes due to the variation of the mass flow balance between the upstream 5th stand and the 6th stand.

The targeted thickness of the joint at the delivery side of the mill $h_5^{ad}$ of the 5th stand is determined so that the ratio $h_5^{ad}/h_5^{ac}$ of the targeted thickness of the joint to the targeted thickness of the sheet of the stationary zone is set at 1 or more, and not greater than of the ratio $h_6^{ad}/h_6^{ac}$ of the targeted thickness of the joint to the targeted thickness of the sheet of the stationary zone at the 6th stand, for example, the same ratio as that of the 6th stand.

The grounds is that the mass flow balance is maintained between the (i−1)-th stand and i-th stand not to generate the tension variation as shown in the following equation:

$$\{VR_{i-1}\cdot(f_{i-1}+1)\}/\{VR_i\cdot(f_i+1)\}=(h_i/H_i) \quad (14)$$

wherein f represents the forward slip, VR represents the roll peripheral speed, and i represents the stand number.

When the ratio $(h_i/H_i)$ of the thickness of the sheet at the delivery side of the mill to the thickness at the inlet side is set to a constant, the mass flow balance can be maintained without changing the roll peripheral speed, resulting in the decreased tension change. The thickness $H_i$ at the inlet side of the mill corresponds to that in which the thickness $(h_{i-1})$ at the delivery side of the mill of the (i−1)-th stand is delayed by the transferring time between stands.

The ratio of the targeted thickness $(h_i^{ad}/h_{i-1}^{ad})$ of the joint at the delivery side of the mill to the thickness at the inlet side becomes the ratio $(h_i^{ac}/h_{i-1}^{ac})$ of the targeted thickness of the stationary zone at the delivery side of the mill to the thickness at the inlet side, in such a manner. Thus, the tension variation can be reduced by equality of the ratio $(h_{i-1}^{ad}/h_{i-1}^{ac})$ of the targeted thickness of the joint at the delivery side of the mill to the targeted thickness of the stationary zone at the delivery side of the mill of the (i−1)-th stand and the ratio $(h_i^{ad}/h_i^{ac})$ of the targeted thickness of the joint at the delivery side of the mill to the thickness of the targeted thickness of the stationary zone at the delivery side of the mill of the i-th stand.

When the ratio at the 5th stand is equal to that at the 6th stand, since the tension varies between the upstream 4th stand and the 5th stand, the ratio at the 5th stand may be reduced to less than that of the 6th stand to disperse the mass flow variation. When the ratio of the targeted thickness of the joint at the delivery side of the mill to the targeted thickness of the stationary zone at the delivery side of the mill is decreased toward the upstream, the mass flow variation is dispersed at each stand so as to not concentrate the tension variation to a specified stand.

On the other hand, when the roll gap of the 6th stand as the standard stand is changed, since the mass flow changes down stream between the 6th and 7th stands with the tension variation, the ratio of the targeted thickness of the joint to the targeted thickness of the stationary zone at the delivery side of the mill of the 7th stand is preferably set to the ratio of the targeted thickness of the joint to the targeted thickness of the stationary zone at the delivery side of the mill of the 6th stand.

Figure 13:
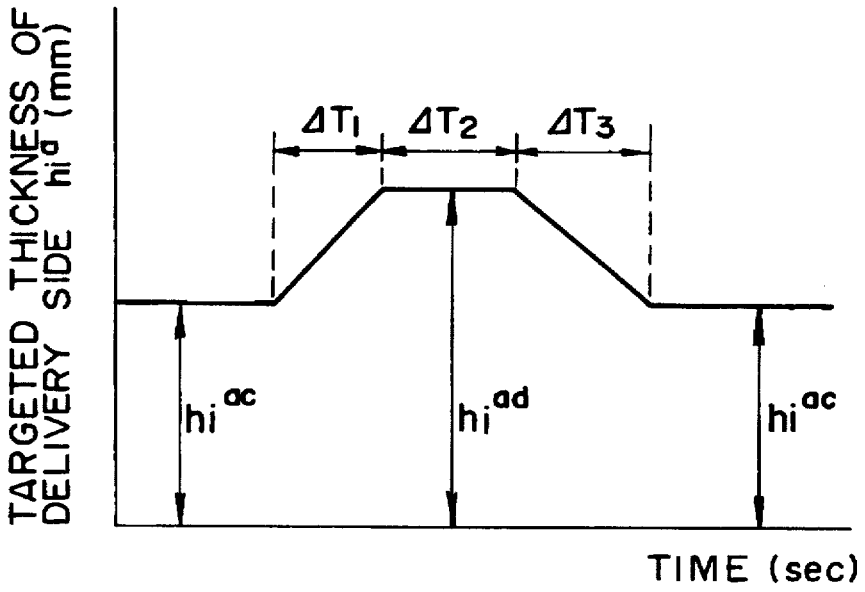
FIG. 13 is a graph illustrating the pattern for changing the roll gap (of the targeted thickness of the sheet at the delivery side of the mill) in accordance with the present invention.

The pattern for changing the roll gap is shown in FIG. 13, in which the changing time is set at $\Delta T_1$ on changing the roll gap from the target thickness of the stationary zone to the target thickness of the joint and the changing speed of the thickness of the sheet is maintained constant. After an elapse of $\Delta T_1$, the thickness of the joint at the delivery side of the mill is maintained during $\Delta T_2$. Then, the changing time from the thickness of the joint at the delivery side of the mill to the thickness of the stationary zone at the delivery side of the mill is set at $\Delta T_3$ and the speed for changing the thickness of the sheet is maintained constant.

Such a trapezoid pattern, in which the starting section and the end section are tapered, is more preferably employed. The changing times $\Delta T_1$, $\Delta T_2$, and $\Delta T_3$ for changing the roll gap must be in agreement in each stand. Although the thickness of the sheet decreases and the distance of the changing section of the thickness increases at the later stand, the mass flow is constant. Thus, it is sufficient to match the time required for the thickness change.

The thickness change starts from the same position of each stand by tracking the starting point of the thickness change immediately after joining. Applicable tracking methods include conventional methods, e.g. the position determination by the measuring roll or the transferring speed of sheet.

A trapezoid pattern is suitable for changing the roll gap because the drastic mass flow change is prevented and the tension variation is decreased due to the rolling reduction apparatus operation in synchronism with the thickness change. If the tracking error of the joint occurs and the starting point of the thickness change shifts at each stand on the thickness change at a plurality of stands, the mass flow fluctuation can be decreased more as compared to the rectangular changing pattern.

As set forth above, by finish-rolling the joint so that its thickness is thicker by a predetermined value, for example, around 0.3 mm of the thickness of the stationary zone, the cross section at the joint increases and the unit tension affecting the sheet is reduced, resulting in preventing rupture of the sheet.

FIG. 5 is an embodiment suitable for performing the present invention. A finishing rolling process is continuously carried out by means of joining the rear end of the preceding steel piece and the leading end of the succeeding steel piece using a joining device 5 provided between the delivery side of the mill of a rough rolling mill 3 and the inlet side of the mill of a continuous rolling mill group 6. The joined steel pieces are continuously rolled with the finish rolling mills 6, and are cut at appropriate positions with a cutter 9 and then coiled with a coiler 8. The leading end of the succeeding strip is sent to be coiled to the coiler 8'. Each finish roller 6 is a roll crossed roller provided with a work roll bender to generate the work roll bending force.

Figure 19A:
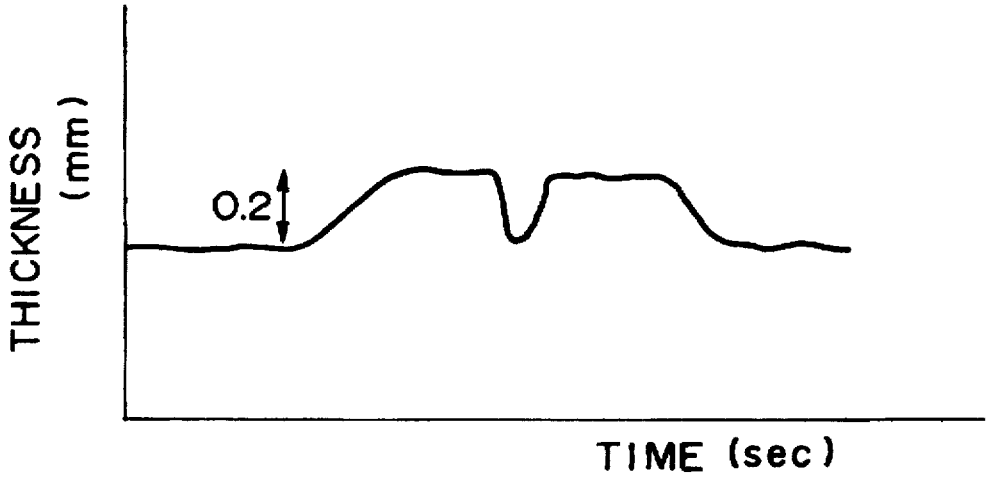
FIGS. 19A and 19B are graphs illustrating the thickness distribution and force variation near the joint.
Figure 19B:
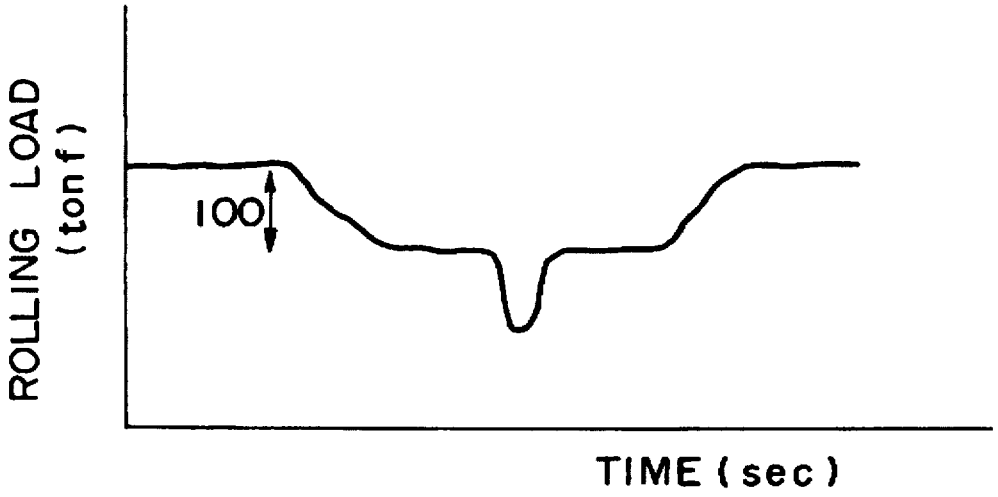

In order to prevent the decrease in the thickness of the joint as set forth above, a method for finish-rolling the joint and its predetermined vicinity to a thickness greater than the thickness of the stationary zone is proposed as shown in FIG. 19A. The rolling force is changed with the thickness variation as shown in FIG. 19B. Since the crown at the delivery side of the mill of the sheet thickness changing stand varies with the force variation, the sheet shape at the delivery side of the mill also varies. The sheet shape variation is noticeable in wider rolled materials.

In the present invention, after the shape variation is estimated, the shape variation is prevented by the effect of the work roll bending force within the range of the rolling force variation. The shape variation and bending force at the thickness change are calculated on-line or off-line as follows.

The rolling force variation at the thickness change is obtained by equation (21):

$$\Delta P = M^*(\Delta H - \Delta S) \tag{21}$$

wherein $\Delta S$ is the changing amount of the roll gap, $\Delta H$ is the changing amount of the thickness, $\Delta P$ is the rolling force variation, and the M is the mill modulus constant. Further, the change of the strip crown $\Delta Cr$ at the delivery side of the rolling mill is determined as follows:

$$\Delta Cr = A^*\Delta P \tag{22}$$

where A represents the influence coefficient of the force variation to the crown change and is experimentally determined by the thickness, width, kind of the steel, of the rolled material. The shape of the sheet of the rolled material is generally represented by the steepness $\lambda$. The steepness $\lambda$ is represented by $\lambda = \chi/1$ wherein $\chi$ represents the wave height of the sheet shape and the 1 represents the wave pitch. Further, it is known that there is the following correlation between the $\lambda$ and $\Delta Cr$:

$$\lambda = \pm 2/\pi \sqrt{\frac{|\Delta Cr^*\xi}{H}} \times 100(\%) \tag{23}$$

wherein $\xi$ represents the shape change factor and the H represents the thickness of the sheet at the delivery side of the mill of the stand.

The sheet shape at the changing thickness can be estimated in such a manner.

Then, the crown change at the delivery side of the mill due to the bending force variation is determined by equation 24 similar to equation (2):

$$\Delta Cr = B^*\Delta Fw \tag{24}$$

wherein $\Delta Fw$ represents the changing amount of the bending force and B represents the influence coefficient of the bending force variation to the crown change at the delivery side of the mill and is experimentally determined by the thickness of the sheet, width of the rolled material, and the type of the steel. From equations (22) and (24), the bending force (25) required to suppress the shape change formed by the force variation at the thickness change is expressed by equation (25):

$$\Delta Fw = A/B^*\Delta P \tag{25}$$

Figure 20:
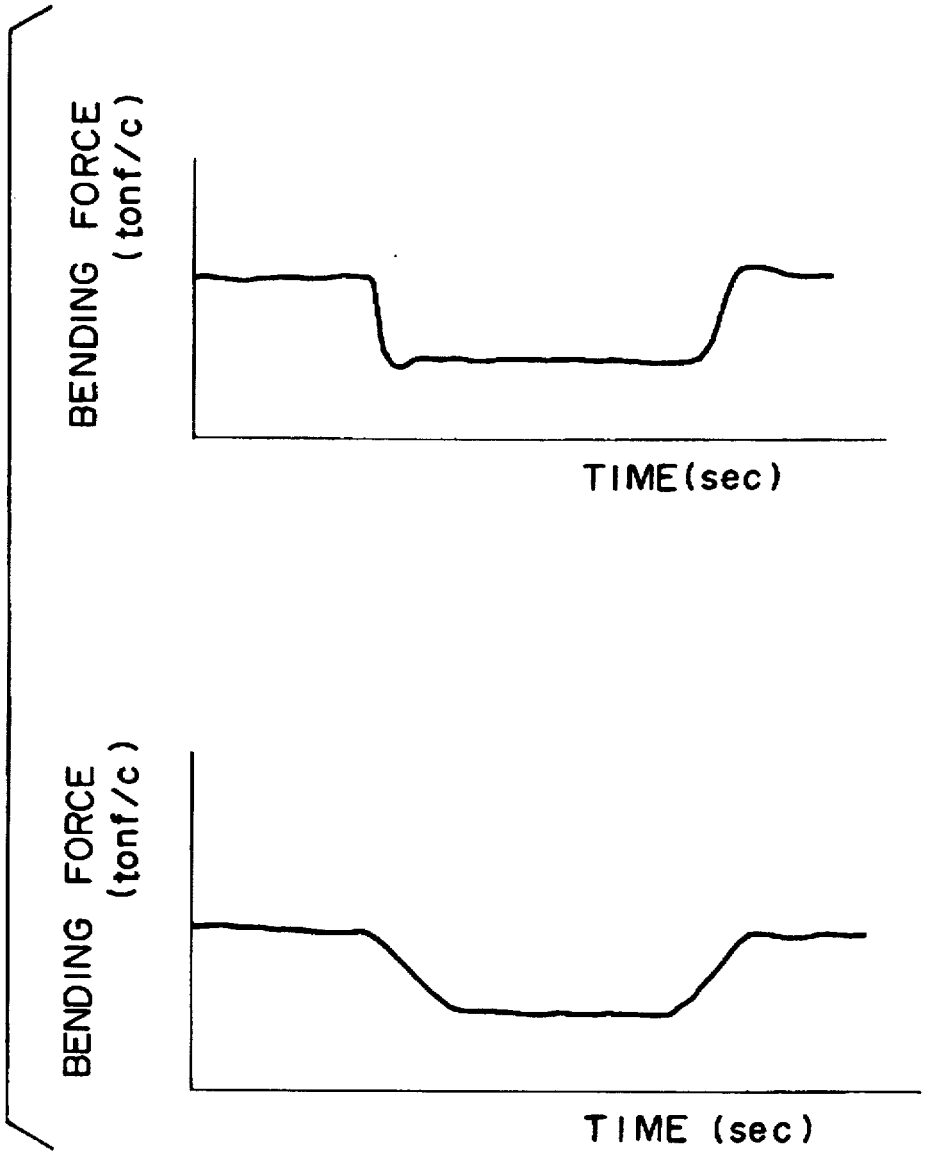
FIG. 20 is a graph illustrating the method for changing the bending force.

The bending force determined by the method set forth above is affected at the joint and its vicinity as shown in FIG. 20. The applied bending force may be rectangular or tapered. This method can prevent the sheet shape change at the thickness changing section.

Figure 21:
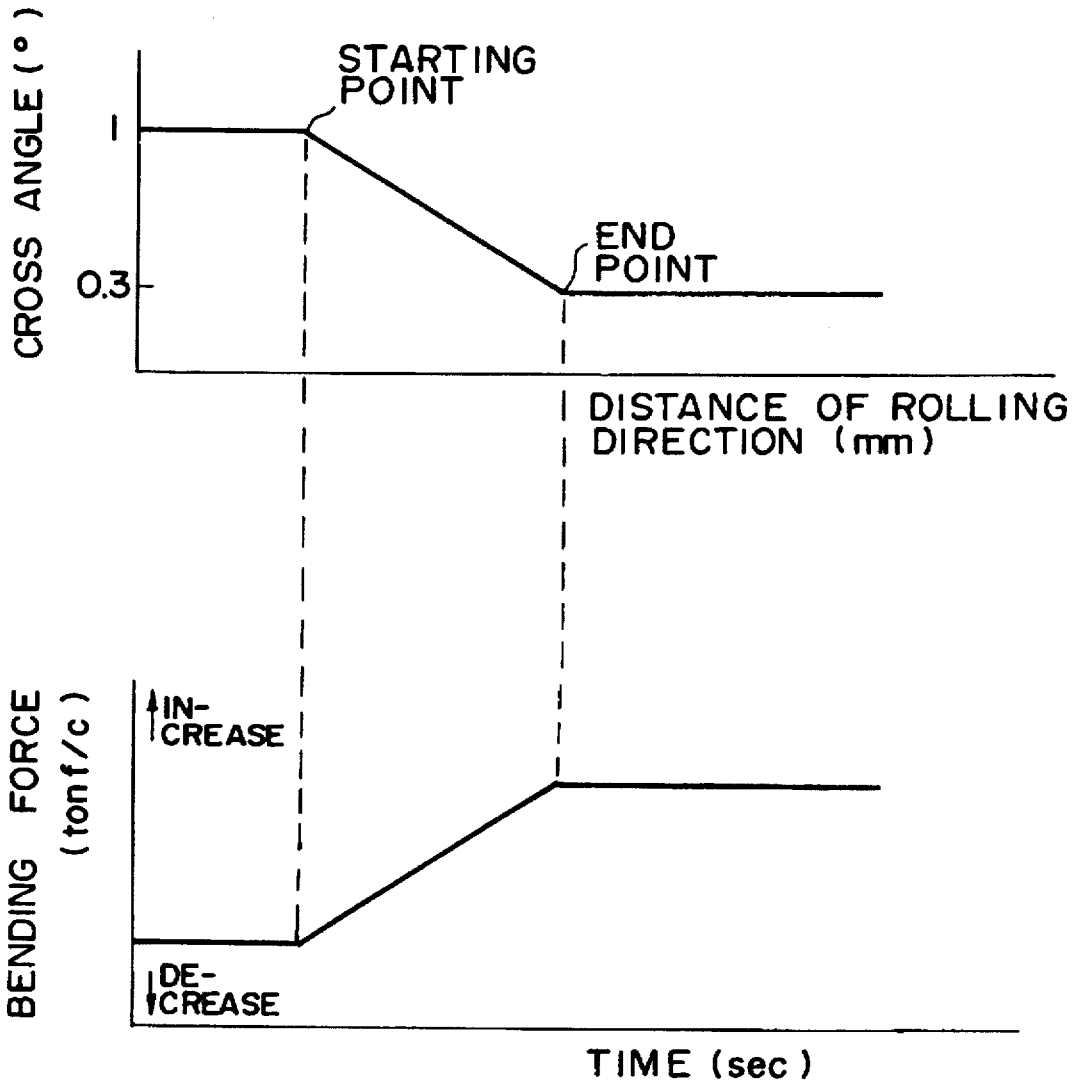
FIG. 21 is a graph illustrating the change of the cross angle during rolling and the change of the bending force.

When a dynamic strip crown control using a profile sensor is applied to the rolled material, the absolute value of the bending force shifts from the default value at the time affecting the bending force, so the sufficient bender power to suppress the shape change formed at the thickness changing section may be not secured. Further, the changing amount of the predetermined bending force sometimes cannot be held between the default value and specified upper/lower limits of the bending force. In such a case, e.g. roll cross rolling mill, the effective method is to change the cross angle during rolling and the bending force to a predetermined value at the same time before the joint and its predetermined vicinity reach the rolling mill. In order to not inhibit the sheet passage due to the sheet change formed by the cross angle change as shown in FIG. 21, the bending force may be changed in synchronism with the cross angle change. The crown change at the delivery side of the mill formed by the cross angle change is expressed as $$\Delta Cr = C^*\{(\theta_2)^2 - (\theta_1)^2\} \tag{26}$$

wherein $\theta_1$ represents the cross angle before the change, $\theta_2$ represents the cross angle after the change, and C is the influence coefficient of the cross angle variation to the crown change at the delivery side of the mill, experimentally determined by the thickness, width and type of the steel. Thus, from equations (24) and (26), the changing amount of the cross angle required for not changing the sheet shape to the predetermined change of the bending force is expressed by the following equations:

$$\{(\theta_2)^2-(\theta_1)^2\}=B/C*\Delta Fw \quad (27)$$

In such a manner, the bending force required for preventing the shape change at the thickness change can be secured, and no shape change occurs due to the lack of the bending force.

The present invention can be carried out with a similar result on any rolling mill having a shape controlling actuator other than the roll cross rolling mill, e.g. a variable crown roll (VC roll) for changing the convex crown shape, work roll shift mechanism, and intermediate roll shift mechanism of the six high rolling mill.

EXAMPLE

After steel pieces of 1,200 mm wide and 30 mm thick were subject to joining (the rear end of the preceding steel piece and the leading end of the succeeding steel piece were induction-heated and butted with press to join), continuous hot finish rolling was carried out by using an apparatus, as shown in FIG. 5, having seven stands arranged in tandem.

Example 1

The rolling with the change of the bending force was carried out at the 7th stand, i.e., the final stand, on rolling the joint of the steel pieces. The changing pattern of the bending force was rectangular and the changing time was 0.5 seconds. The joint temperature was +200° C. in relation to its marginal temperature at the time of the completion of joining of the steel pieces.

As a result of the calculations of the temperature during the finish rolling process and of the rolling force based on such conditions, the force variation at the 7th stand on rolling the joint of the steel pieces was estimated at −200 tonf. Further, the $\alpha/\beta$ ratio, i.e., the influence coefficient $\alpha$ of the rolling force to the rolling mill deflection and the influence coefficient $\beta$ of the bending force to the rolling mill deflection were 0.1 according to a predetermined calculation. Thus, the bending force, calculated by equation (1), corresponding to the force variation was −20 tonf/chock. The changing amount of the bending force of the 7th stand was set at this value.

The joint position immediately after the completion of joining the steel pieces was memorized in the tracking device, the joint was tracked in response to the transferring speed of the steel pieces, and the bending force of the 7th stand was changed when the joint reaches the 7th stand.

Figure 6:
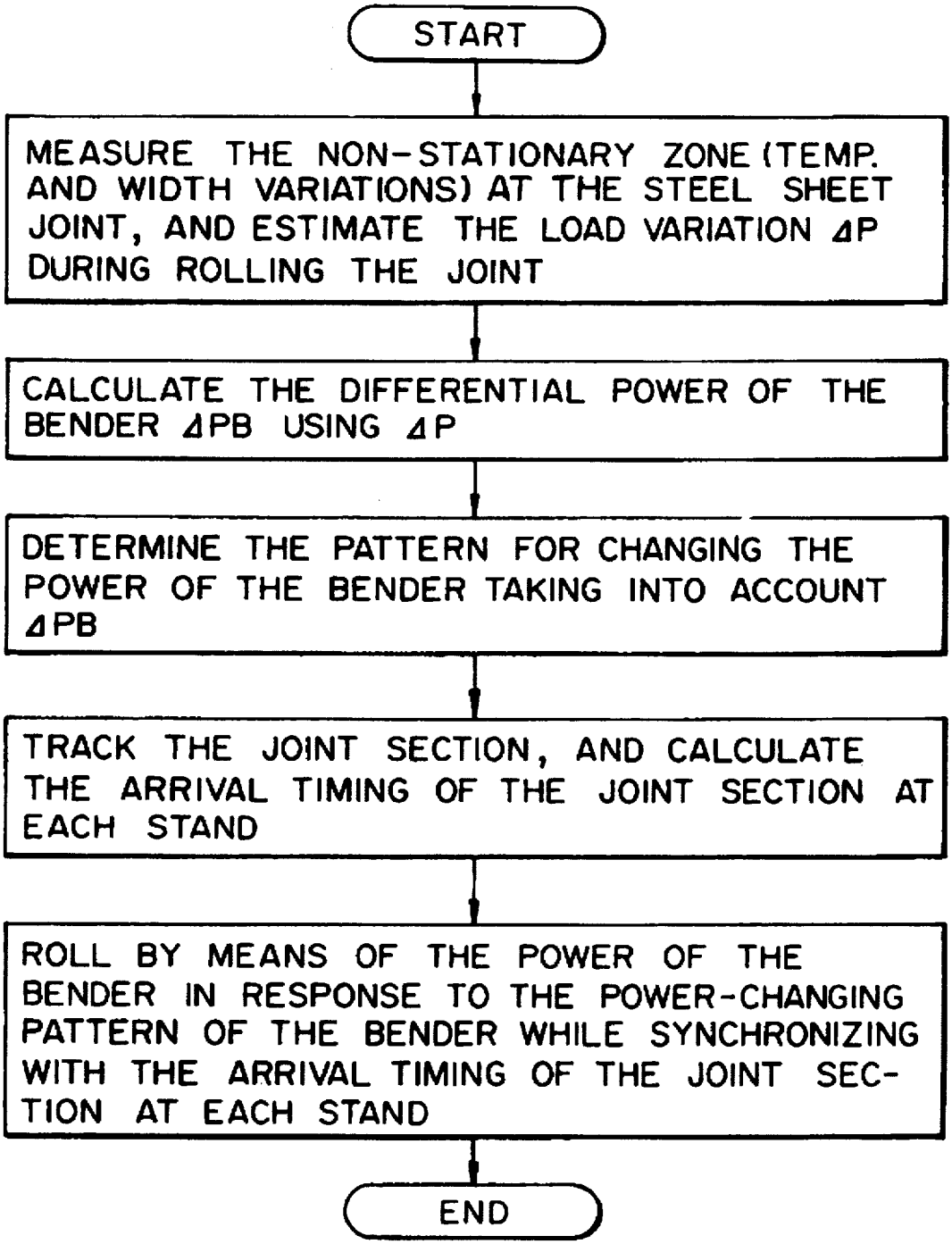
FIG. 6 is a flow chart illustrating the process from the determination of the changing pattern of the bending force to the rolling of the joint.
Figure 7:
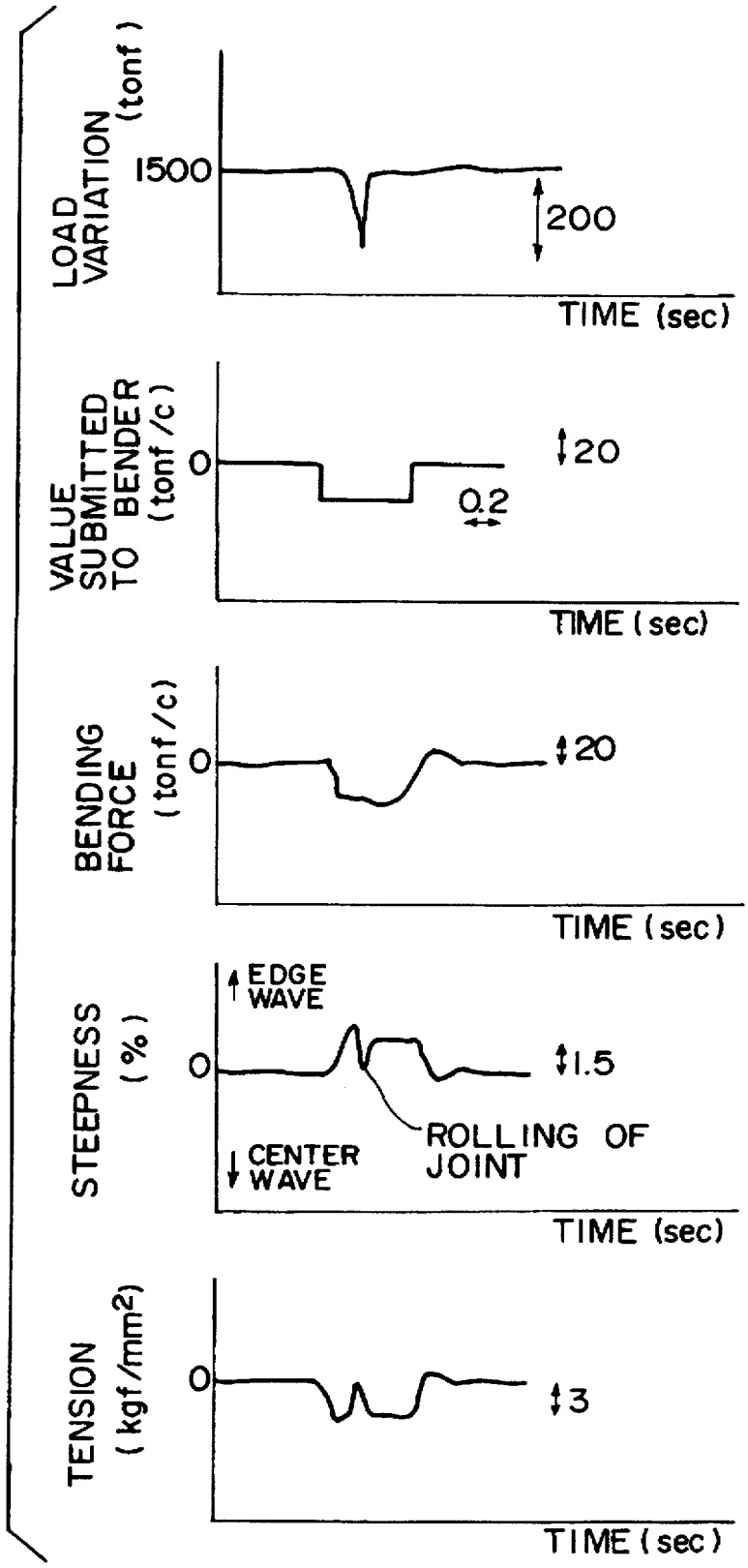
FIG. 7 is a graph illustrating the status of the value of the bender, bending force, steepness, and tension during rolling the steel piece in accordance with the present invention.

The changing mode of the bending force is shown in FIG. 6, and the corresponding bending force, steepness, and tension occurred at the width edge of the joint are shown in FIG. 7. FIG. 7 demonstrates that a noticeable tension force does not form at the width edge of the joint during rolling the steel pieces and no rupture of the sheet was observed.

Example 2

Example 2 is a case in which the force increases at the joint.

In low finish delivery-side temperature (FDT) materials causing any transformation in the finish rolling mill, the force at the joint sometimes increases compared with the stationary zone, even if the joint temperature is higher than its marginal temperature. This phenomenon is due to the increased flow stress with temperature raising, at the temperature below the AR3 transformation temperature, and where the joint has an edge wave shape, and if any unjointed portion remains at the width center some extension force works at the unjointed portion, resulting in the rupture. The present invention has similar effects in such a case as described below.

The change of the bending force by means of the method for controlling the joint shape in accordance with the present invention was carried out at the 7th stand. The changing pattern of the bending force was rectangular and the changing time was 0.5 seconds.

The joint temperature was +200° C. in relation to its marginal temperature after joining of the steel pieces. As a result of the calculations of the temperature during the finish rolling process and of the rolling force based on such conditions, the force variation at the 7th stand on rolling the joint of the steel pieces was estimated at +200 tonf. Further, the $\alpha/\beta$ ratio, i.e., the influence coefficient $\alpha$ of the rolling force to the rolling mill deflection and the influence coefficient $\beta$ of the bending force to the rolling mill deflection were 0.1 according to a predetermined calculation. Thus, the bending force, calculated by equation (1), corresponding to the force variation was +20 tonf/chock. The changing amount of the bending force of the 7th stand was set at this value.

Figure 11:
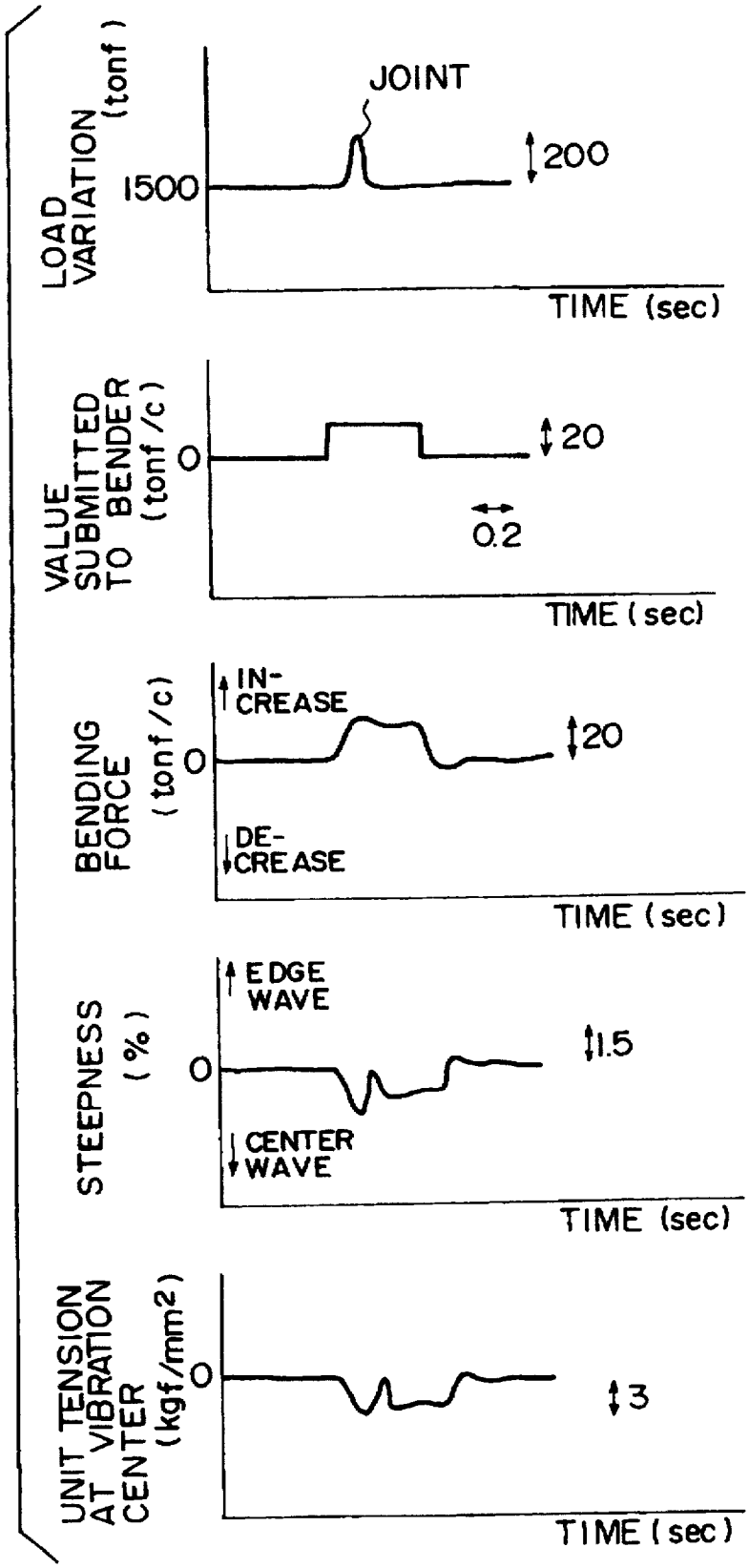
FIG. 11 is a graph illustrating the status of the force variation, value of the bender, bending force, strip crown, steepness, and tension during rolling the steel piece in accordance with the present invention.

Similar to Example 1, the joint position immediately after the completion of joining the steel pieces was memorized in the tracking device, the joint was tracked in response to the transferring speed of the steel pieces, and the bending force of the 7th stand was changed when the joint reaches the 7th stand. The bending force, steepness of the sheet, and tension occurred at the width edge of the joint at the 7th stand are shown in FIG. 11. FIG. 11 demonstrates that a noticeable tension force does not work at the width edge of the joint during rolling of the steel pieces and no rupture of the sheet was observed.

Example 3

The changing amount of the bending force was determined and the bending force was changed at the 7th stand similar to Example 1. The changing time of the bender was set at 0.8 seconds based on the tracking error time, 0.3 seconds, of the joint at the 7th stand and the response delay time, 0.2 seconds, of the bender.

Figure 8:
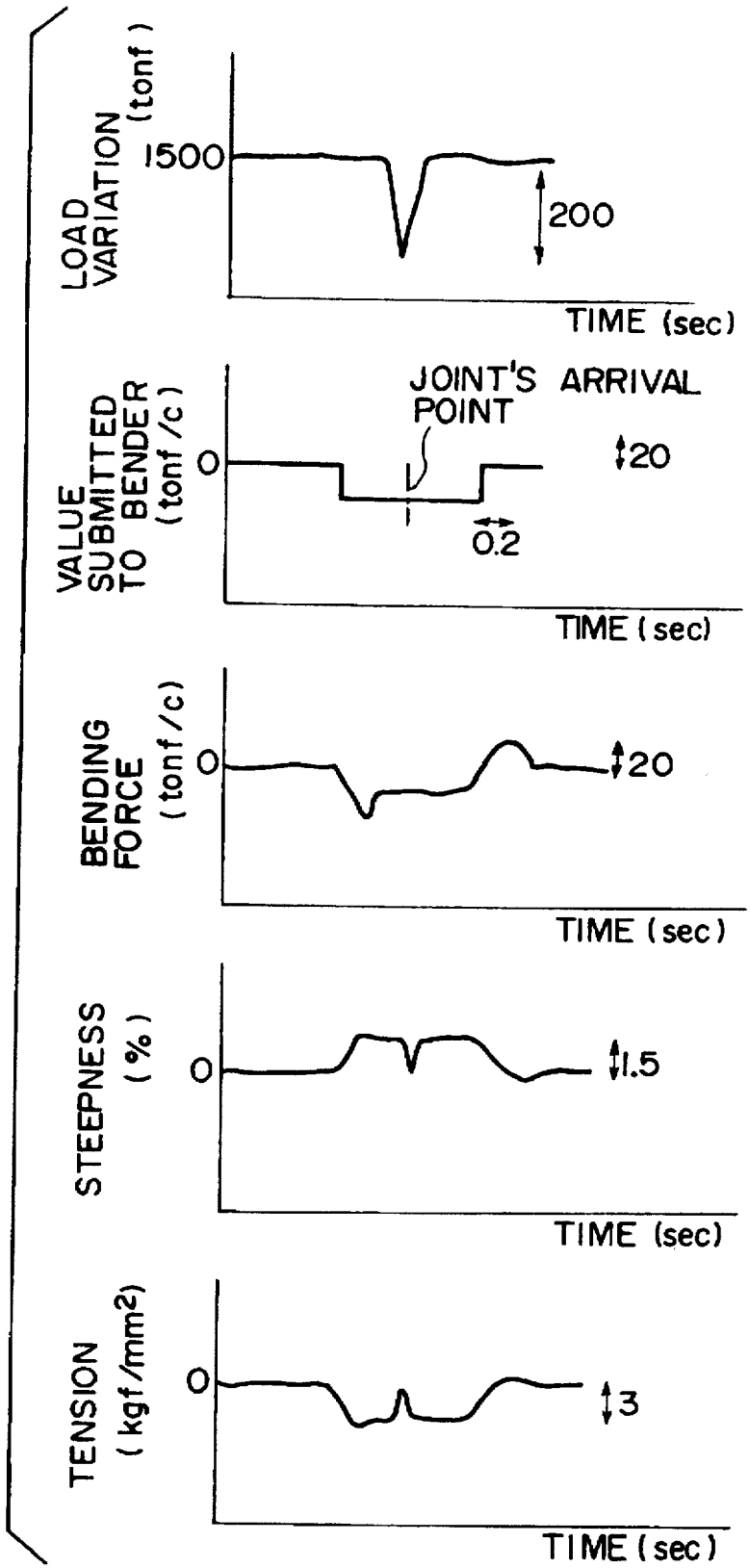
FIG. 8 is a graph illustrating the status of the value of the bender, bending force, steepness, and tension during rolling the steel piece in accordance with the present invention.

The bending force, steepness, and tension which occurred at the width edge of the joint at the 7th stand are shown in FIG. 8.

In Example 1, since the changing time of the bender is set at 0.5 seconds and the tracking error time at the 7th stand is 0.3 seconds, the change of the bending force may be carried out at any section other than the joint and the rupture of the sheet may occur due to the center wave at the joint. In contrast, in Example 3, since the changing time of the bending force is set taking account of the tracking error time, rolling without a rupture of the sheet can be achieved.

Example 4

The changes of the bending force at the joint of the steel pieces were effected at the 5th, 6th, and 7th stands. The changing pattern of the bending force was rectangular and the changing time of the bender was set at 0.8 seconds based on the maximum tracking error time, 0.3 seconds (at the 7th stand), of the joint at the 5th through 7th stands and the response delay time, 0.2 seconds, of the bender.

As a result of the calculations before rolling, the force variations at the 5th through 7th stands were estimated at −100 tonf, −150 tonf, and −200 tonf, respectively, and the corresponding bending forces were estimated at −10 tonf/chock, −15 tonf/chock, and −20 tonf/chock, respectively. The changing amount of each bending force was set in response to the corresponding bending force.

Figure 9:
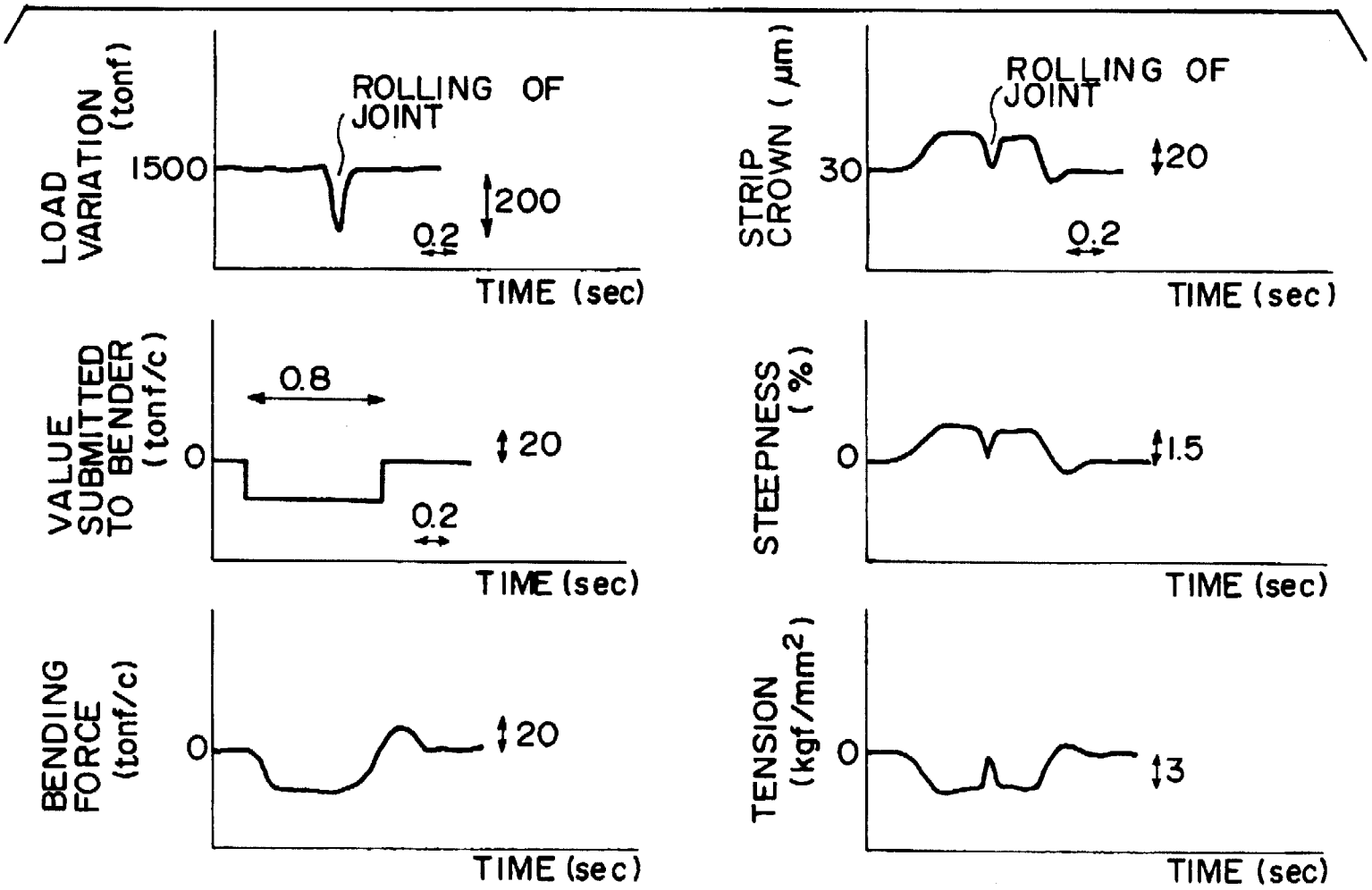
FIG. 9 is a graph illustrating the status of the force variation, value of the bender, bending force, strip crown, steepness, and tension during rolling the steel piece in accordance with the present invention.

FIG. 9 shows results of this example, i.e. the dependence of the rolling force, value submitted to the bender, bending force, strip crown at 25 mm inside the width edge of the sheet, steepness, and tension on the time, at the final (7th) stand.

Figure 10:
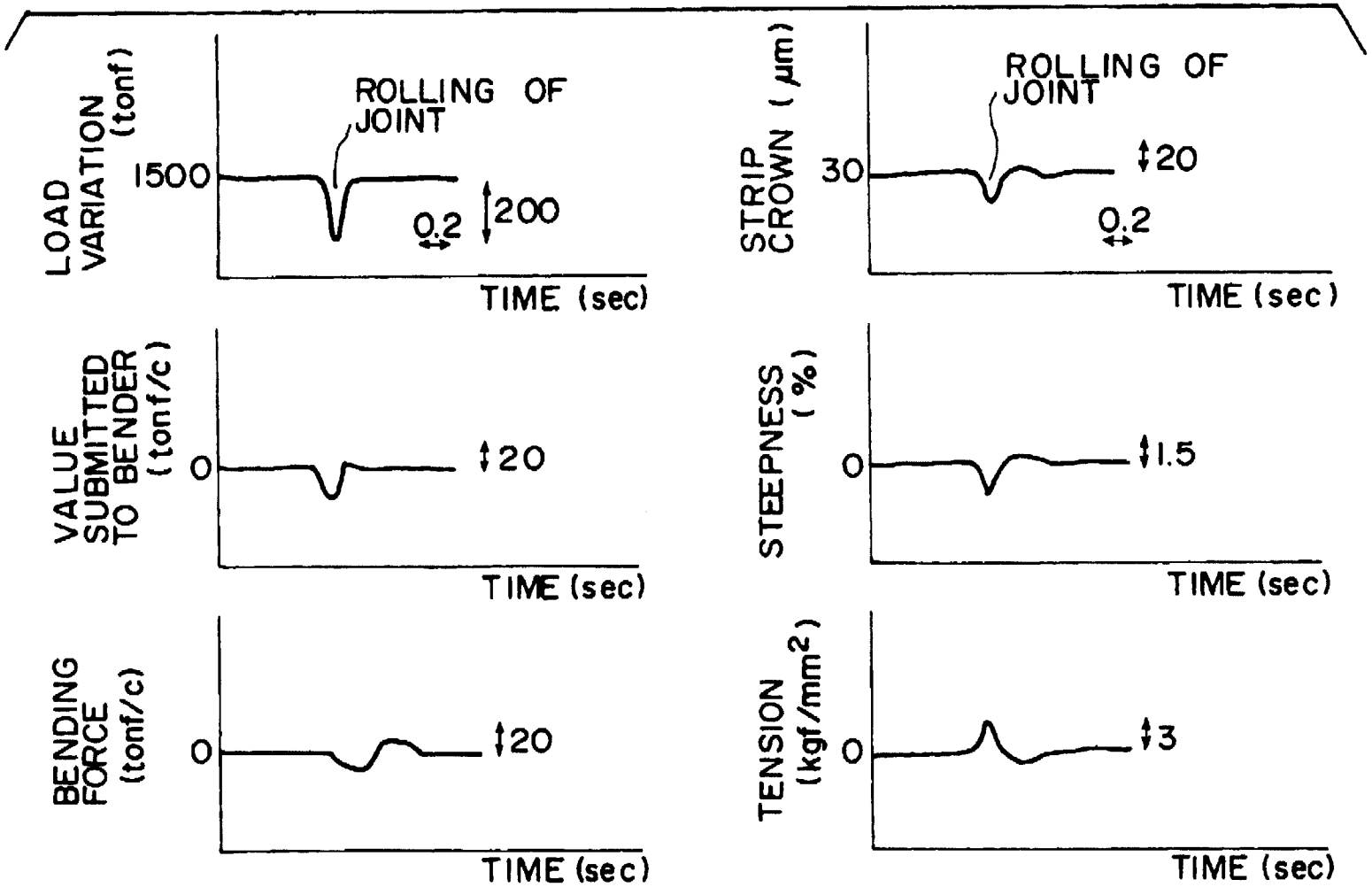
FIG. 10 is a graph illustrating the status of the force variation, value of the bender, bending force, strip crown, steepness, and tension during rolling the steel piece in accordance with the prior art.

FIG. 10 shows results based on a rolling force following feedback control method to the joint by means of a conventional bender control, similar to FIG. 9.

In the rolling force following feedback control method by means of the conventional bender control, the rolling force decreases by approximately 200 tonf at the joint of the steel pieces as shown in FIG. 10, whereas the changing amount of the bending force corresponds to −20 tonf/chock, and the force change at the joint drastically occurs within 0.2 second. Since the conventional feedback control cannot trace such a steep change due to delayed response, a sufficient bending force does not work at the joint, the strip crown at the joint decreases, the tension at the width edge of the joint reaches 3 kgf/mm$^2$ (positive for the tension side), and the sheet ruptures at the joint during rolling.

In contrast, in the case of the application of the present invention as shown in FIG. 9 in which the bending force is changed with a pattern at the joint and its vicinity during rolling of the joint, the changing amount of the strip crown at the joint becomes extremely small at the stationary zone, and the tension formed at the width edge at the joint is reduced. As a result, harmful effects due to the tension force causing the sheet rupture are removed at the width edge of the joint.

In Examples 5 and 6, a rolling apparatus (7 stand tandem mill, pair cross rolling mill for all stands, WR bending force ±1,000 kN/c for each stand) was used as shown in FIG. 5, and a low carbon steel sheet bar of 30 mm thick and 1,000 mm wide was subject to joining (the steel pieces were induction-heated and butted with a press to join each other) and continuous hot rolling to obtain a sheet having a finish thickness of 1.0 mm.

Example 5

The temperature of the joint immediately after joining the sheet bar was approximately 100° C. higher than that of the stationary zone. The decreased thickness at the joint between the 6th and 7th stands after the conventional rolling process was 0.23 mm. Since the thickness of the joint is the same as that of the stationary zone in order to achieve the cross section of the joint required for no sheet rupture between the 6th and 7th stands, the 6th stand was set at the standard stand, the targeted thickness at the delivery side of the mill was determined to 1.56 mm, and the targeted thicknesses at other stands were determined based on the above thickness.

The changing amount ΔS of the roll gap at the 6th stand was +0.6 mm. Table 1 shows the targeted thickness (schedule) of the stationary zone and joint at the delivery side of the mill of each stand when rolling was carried out in accordance with the present invention.

TABLE 1

| Position | Steel bar | F1 | F2 | F3 | F4 | F5 | F6 | F7 |
|---|---|---|---|---|---|---|---|---|
| Stationary Zone Thickness $h^{ac}$(mm) | 30 | 15 | 8.2 | 4.7 | 2.9 | 1.8 | 1.8 | 1.0 |
| Joint Thickness $h^{ad}$(mm) | 30 | 16 | 9.3 | 5.64 | 3.48 | 2.16 | 1.56 | 1.2 |
| Ratio $h^{ad}/h^{ac}$ | — | 1.07 | 1.13 | 1.20 | 1.20 | 1.20 | 1.20 | 1.20 |
| Changing Amount of Bending Force (tonf/c) | | 50 | 50 | 50 | 30 | 30 | 20 | 20 |

The roll gap was changed in accordance with the present invention at each stand having a ratio $h^{ad}/h^{ac}$ of greater than 1.0 as shown in Table 1, wherein the changing time of the thickness of the sheet was set at 2.0 seconds for ΔT, 0.6 second for $\Delta T_1$, 0.6 second for $\Delta T_2$, and 0.8 second for $\Delta T_3$ (refer to FIG. 13).

Immediately after joining the sheet bars, the position of the joint was stored in the tracking device to track based on the transferring speed of the sheet bar. As a result, the mass flow balance at the vicinity of the joint was able to be maintained to stably roll the sheet without an excessive tension.

Figure 14:
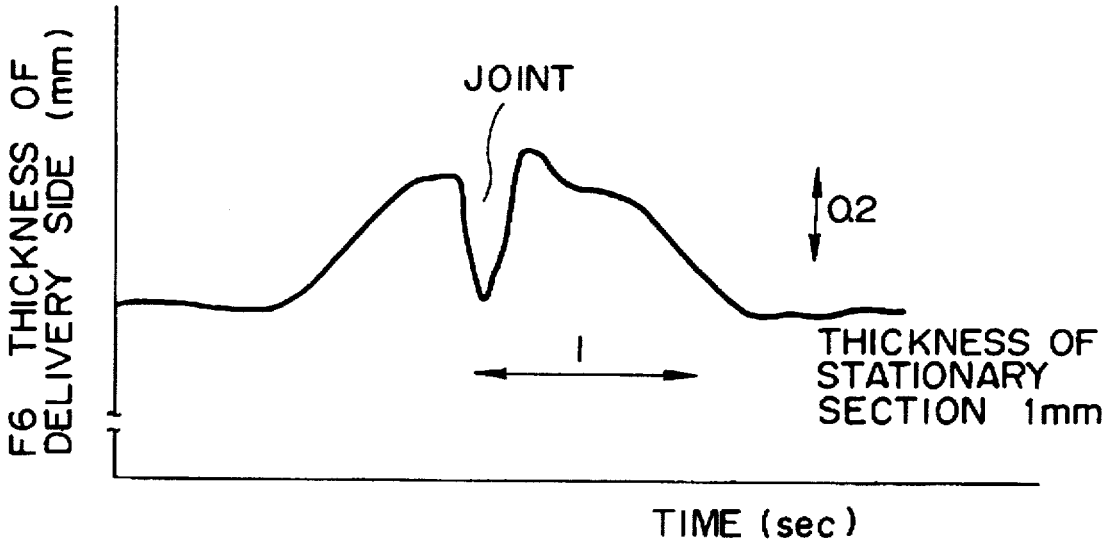
FIG. 14 is a graph illustrating the thickness variation at the delivery side of the mill of the sixth stand.
Figure 15:
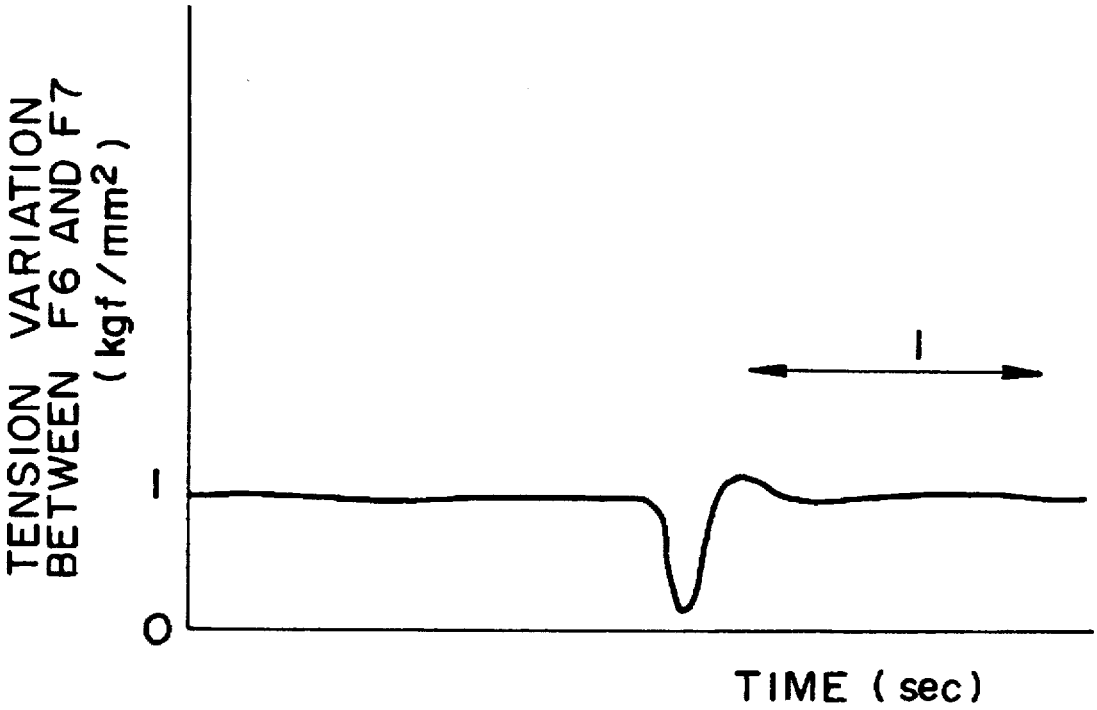
FIG. 15 is a graph illustrating the tension variation between the sixth and seventh stands.

FIG. 14 shows the thickness variation of the joint vicinity at the delivery side of the mill of the 6th stand in the schedule shown in 1, and FIG. 15 shows the tension variation between the 6th and 7th stands when the vicinity of the joint is rolled in the schedule of 1.

In contrast, in the conventional case in which the joint and stationary zone were rolled to the same targeted thickness at the delivery side of the mill, since the tension significantly changes between the 6th and 7th stands to work an excessive tension, rolling is forced to discontinue due to the sheet rupture.

Example 6

The sheets were subject to hot rolling by using a rectangular pattern (Comparative Example, refer to the broken line in FIG. 16) and a trapezoid pattern (Example, refer to the broken line in FIG. 17) as the changing pattern of the roll gap. The finish thickness of the sheet was 1.0 mm, the targeted thickness at the delivery side of the mill was the schedule in Table 1, and other conditions are the same as those in Example 1.

Figure 16A:
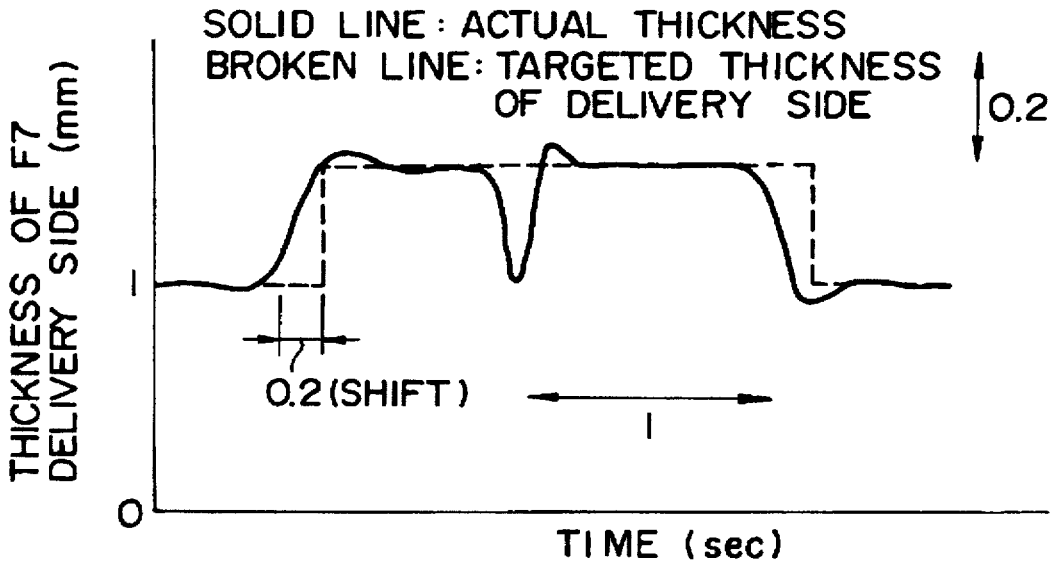
FIGS. 16A and 16B are graphs illustrating the thickness variation at the delivery side of the mill of the seventh stand and the tension variation between the sixth and seventh stands in a comparative example.
Figure 16B:
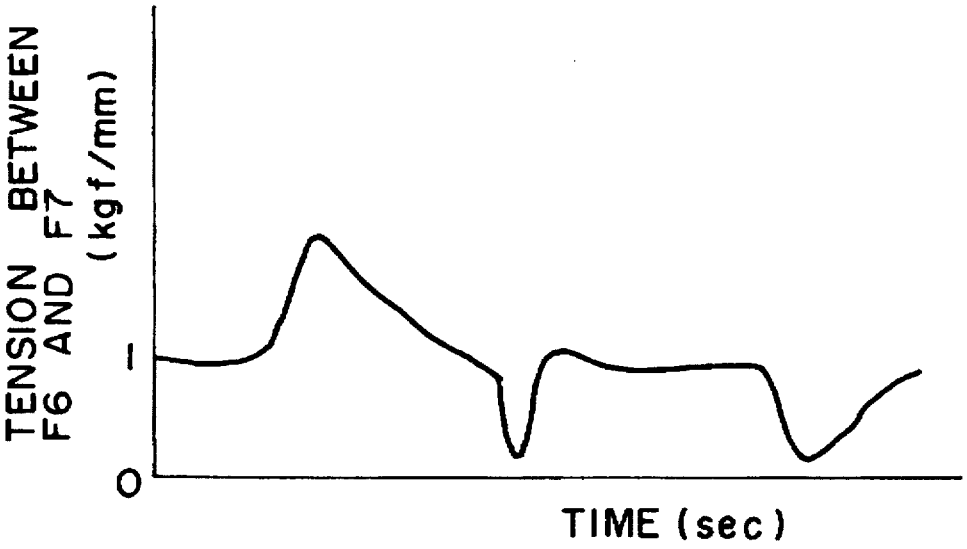

In the Comparative Example in which the roll gap is changed while tracking the position of the joint so as to change the thickness of the sheet by outputting the order for changing the roll gap according to the rectangular pattern when the starting point of the thickness change reaches each stand, since the starting point of the thickness change at the 7th stand shifts by approximately 0.2 second relative to the starting point of the thickness change at the 6th stand due to the tracking error, i.e, after a lapse of 0.2 second after the order for changing the roll gap is outputted to the starting point of the thickness change at the 6th stand reaches the 7th stand, a tension occurs at the starting time of the thickness change at the 7th stand so excessively as to not prevent the sheet rupture. The thickness at the delivery side of the mill of the 7th stand and the tension variation between the 6th and 7th stands are shown in FIGS. 16A and 16B.

Figure 17A:
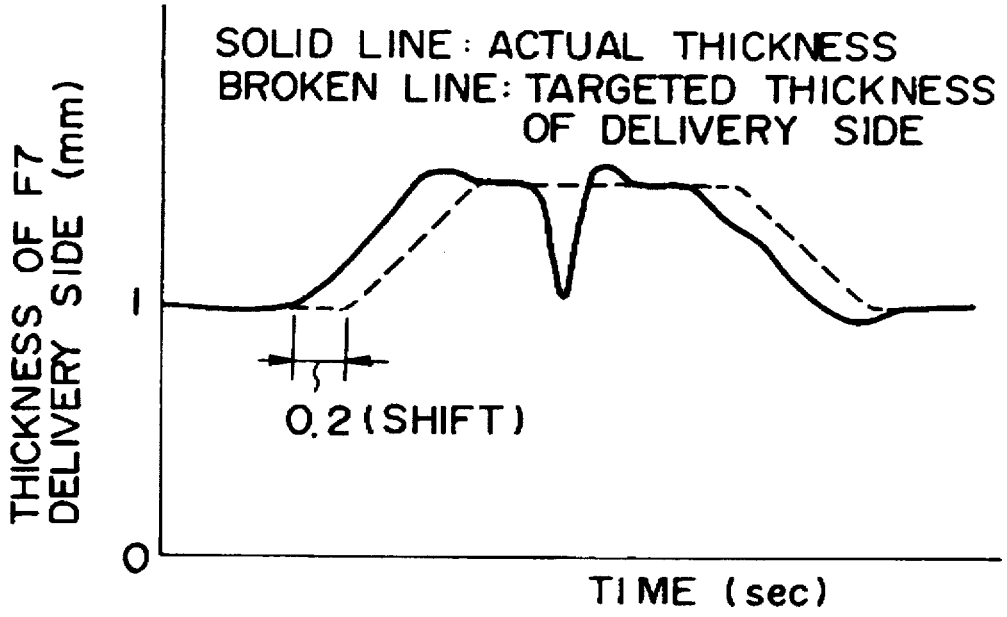
FIGS. 17A and 17B are graphs illustrating the thickness variation at the delivery side of the mill of the seventh stand and the tension variation between the sixth and seventh stands in an example of the present invention.
Figure 17B:
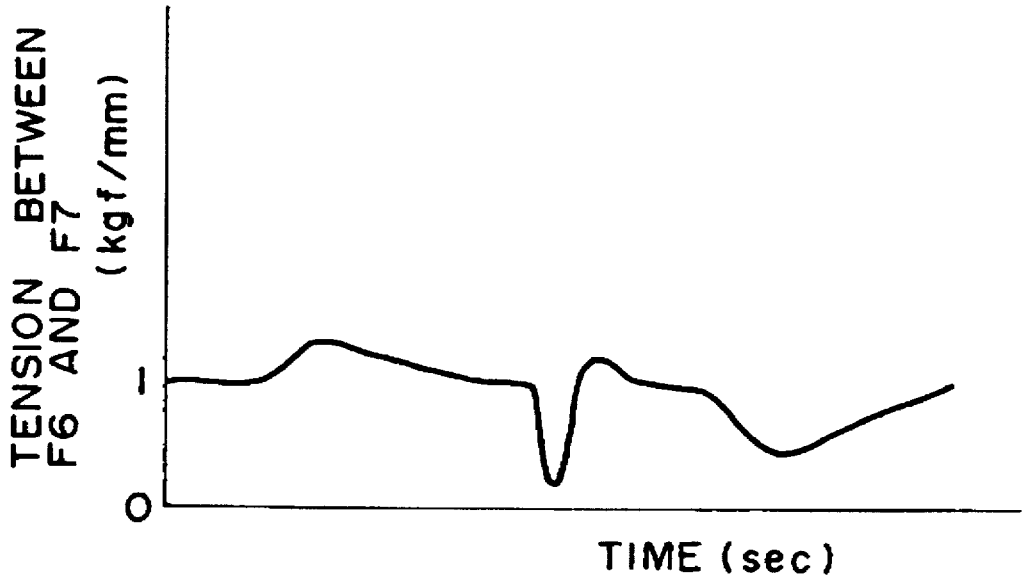

As an Example in accordance with the present invention in which the thickness changing pattern is a trapezoid pattern (refer to the broken line in FIG. 17), although the starting point for changing the thickness of the sheet at the 6th stand reaches the 7th stand after an elapse of 0.2 second after the order for changing the roll gap is outputted at the 7th stand, the mass flow fluctuation is low due to the trapezoid pattern for changing the roll gap. Thus, the tension variation is reduced to achieve a stable rolling operation. FIGS. 17A and 17B show the variations of the thickness of the sheet at the delivery side of the mill of the 7th stand and of the tension between the 6th and 7th stands.

In Examples 7 and 8, a rolling apparatus (7 stand tandem mill, pair cross type rolling mill for all stands, WR bending force ±100 tonf/c for each stand) was used as shown in FIG. 5, and a low carbon steel sheet bar of 30 mm thick and 1,500 mm wide was subject to joining and continuous hot rolling to obtain a sheet having a finish thickness of 2.0 mm. The rear end of the preceding steel piece and the leading end of the succeeding steel piece were induction-heated and butted with a press to join each other.

Example 7

Figure 22B:
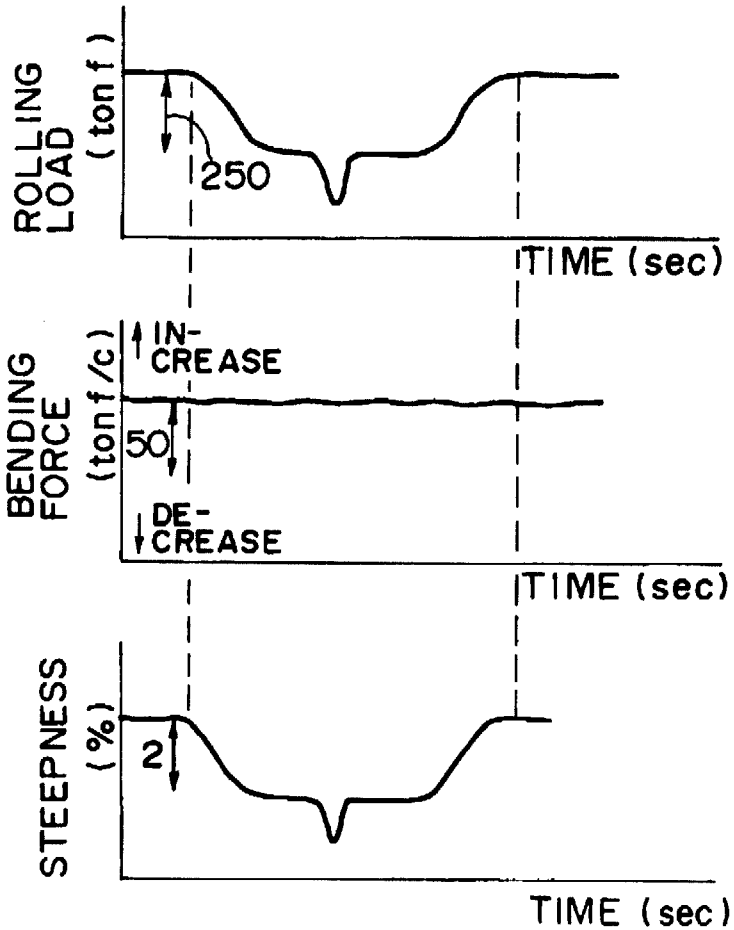
FIGS. 22A and 22B are graphs illustrating the results of a rolling method based on claim 5 in Example 6, and of a rolling method not based on claim 5 in Example 6, respectively.
Figure 22A:
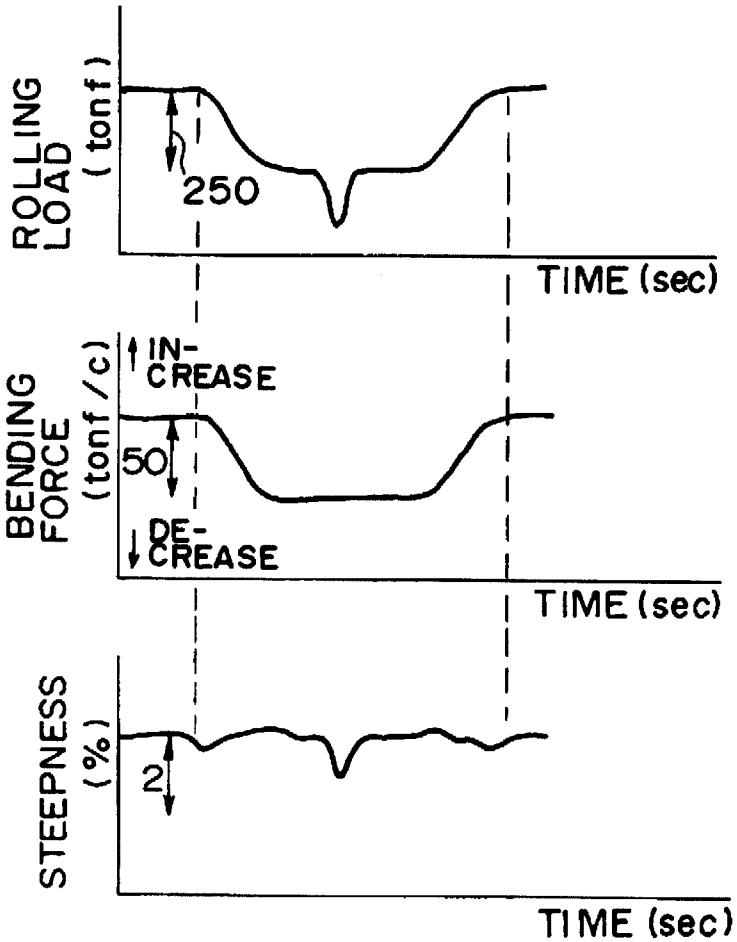

Since the thickness of the joint is 0.5 mm thinner than that of the stationary zone at the 7th finish stand, the sheet was subject to rolling so that the thickness at the joint and the proceeding and succeeding 5 meter regions is 0.5 mm thicker than that of the stationary zone. FIGS. 22A and 22B show the force variations and sheet shape variations, when the WR bending force changes in accordance with the present invention was carried out, and when the change was not carried out, respectively. The rolling force when the thickness of the sheet is changed decreased by 250 tonf relative to that of the stationary zone. The changing amount of the bending force in accordance with the present invention was calculated as −50 tonf/c according to the method set forth above, and the changing pattern of the bending force was tapered like the pattern for changing the thickness of the sheet. Since the rolling force decreases at the changing position of the thickness when the present invention was not carried out, the sheet shape becomes a center wave, resulting in the joint rupture. On the other hand, by changing the bending force in accordance with the present invention, the shape change is reduced in the vicinity of the joint and thus rolling becomes stable.

Example 8

Figure 23B:
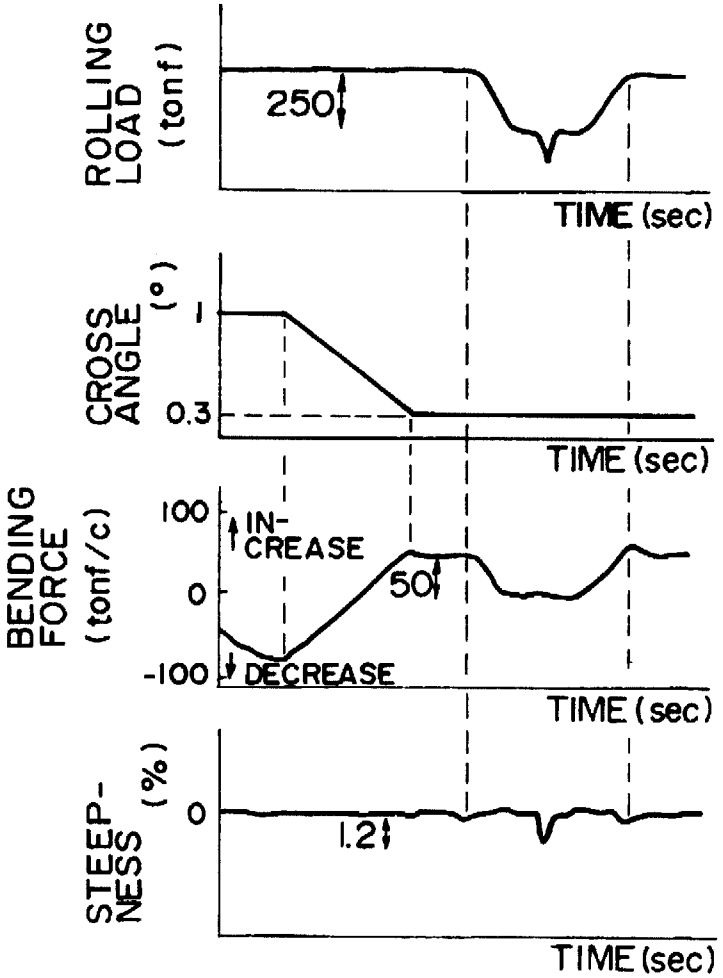
FIGS. 23A and 23B are graphs illustrating the results of a rolling method based on claim 6 in Example 7, and of a rolling method not based on claim 6 in Example 7, respectively.
Figure 23A:
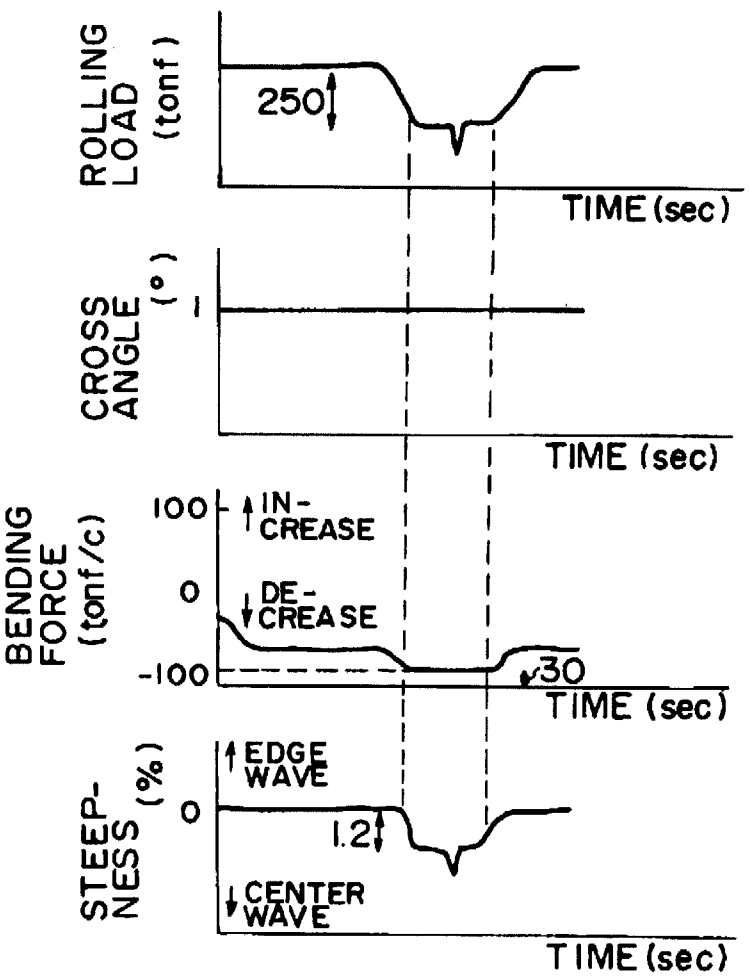

FIG. 23A shows the results when the invention of claim 5 was applied by means of a dynamic strip crown control using a profile meter. Since the thickness at the joint is 0.5 mm thinner than that at the stationary zone at the 7th finish stand like Example 7, the joint and its preceding and succeeding 5 meter region is rolled so as to be 0.5 mm thicker relative to that of the stationary zone. The rolling force at the thickness changing section decreased by 250 tonf relative to the ordinary zone. On the other hand, the changing amount of the bending force in accordance with the present invention was −50 tonf/c according to the above-mentioned calculation. However, the bending force was decreased to −70 tonf/c before the joint and its vicinity reach the 7th stand, since the output for controlling the strip crown is submitted to order the bending force in order to reduce the strip crown variation due to the force variation caused by the temperature variation in the coil. Since the lower limit of the bending force is −100 tonf/c and the minimum changing amount of the bending force is −30 tonf/c in the apparatus, a sufficient changing amount of the bending force cannot be secured at the thickness changing section as shown in FIG. 23A, resulting in the center wave inhibiting rolling.

FIG. 23B shows the results when the invention of claim 6 was applied. The bending force changed to −70 tonf/c before the joint and its vicinity reached the 7th stand. The cross angle was changed by 0.7 deg. before changing the bending force, and the bending force was changed from −70 tonf/c to 50 tonf/c in synchronism with the cross angle change. In such a manner, a sufficient changing amount of the bending force can be secured to the force variation which occurred at the time for changing the thickness of the sheet, and rolling was stably carried out without the shape change at the vicinity of the joint.

According to the present invention, since the tension due to the shape change caused by rolling the joint can be reduced during the continuous hot rolling process of the steel piece, a sheet rupture is prevented during rolling, and the operation becomes stable due to the improved sheet passing property.

What is claimed is:

1. A method for continuously hot-rolling a series of successive pieces of steel into a continuous strip, each of said pieces having a leading end and a rear end, wherein a rear end of a preceding steel piece and a leading end of a succeeding steel piece is butted and joined together, forming a joint therebetween and a non-stationary zone on either side of said joint, said butt-joined steel pieces being finish rolled by a continuous hot rolling mill facility provided with a plurality of rolling stands, each of said stands having a work roll that applies a force to said joint, the method comprising the steps of:

estimating a variation of the rolling force experienced during a rolling of the joint of the steel pieces at the non-stationary zone caused by said joint;

calculating a change in the bending force of the work roll during rolling the joint, said calculation determined from the estimated variation of the rolling force;

determining a bending force pattern for changing the bending force: said pattern taking account of said changing force; and rolling the joint of the steel pieces by regulating the bending force in response to said bending force pattern over at least one stand, while tracking the joint immediately after joining.

2. The method for continuously hot-rolling steel pieces according to claim 1, wherein said pattern for changing the bending force is determined such that the actual forcing time becomes at least $2T_i$, wherein $T_i$ is the difference between a calculated time and an observed time equates to a tracking error time of when the joint reaches an i-th stand.

3. The method for continuously hot-rolling steel pieces according to claim 1, wherein said pattern for changing the bending force is determined by using the maximum tracking error time $T_i$ among the differences between the calculated time and observed time when the method is carried out at a plurality of stands.

4. The method for continuously hot-rolling steel pieces according to claim 1, wherein a targeted thickness of the joint at a delivery side of the mill is set so as to be thicker than a targeted thickness of the sheet of the stationary zones of the preceding and succeeding steel pieces at the delivery side of the mill of at least one stand.

5. The method for continuously hot-rolling steel pieces according to claim 4, wherein the method uses a means for calculating one of an on-line and off-line changing force of a work roll bender controlled by the rolling force variation caused by increasing the thickness of the joint and its neighboring sections and the shape variation of the sheet caused by the force variation wherein the bending force is changed at the thickness-increased portion of the joint and its neighboring sections compared with the stationary zone, in response to changing the bending force.

6. The method for continuously hot-rolling steel pieces according to claim 4, further including the step of providing the rolling mill with a work roll bender and an actuator for controlling a shape of said strip, a controlling amount of said actuator being changed before a change is made to the bending force at a predetermined section along the joint and a neighboring section before and after said joint, said controlling amount changed in response to a predetermined changing bending force wherein the bending force to be changed is set according to a control limitation ability of the bender at a thickness-changing section by preliminarily changing the bending force in synchronism with the change of the controlling amount of the actuator so as to avoid a shape change of the rolled strip material at a starting and an end point of the change.

7. The method for continuously hot-rolling steel pieces according to claim 4, wherein the rolling mill is provided with a work roll bender and a roll cross angle-changing device that is capable of changing a roll cross angle during rolling before the bending force is changed at the predetermined section in response to a predetermined changing bending force, wherein the bending force to be changed is set at within ability of the bender at the thickness-changing section by preliminarily changing the bending force in synchronism with the change of the cross angle so as to avoid a shape change of the rolled material at a starting and an end point of the change of the cross angle.

8. The method for continuously hot-rolling steel pieces according to claim 4, wherein the rolling mill is provided with a work roll bender and a roll shift device, wherein an amount of roll shift during rolling is changed before changing the bending force at the predetermined section in response to a predetermined changing bending force and wherein the bending force to be changed is within the ability of the bender at the thickness-changing section by preliminarily changing the bending force in synchronism with the change of the amount of the shift so as to avoid a shape change of the rolled material at a starting and an end point of the change of the amount of the shift.

9. The method for continuously hot-rolling steel pieces according to claim 2, wherein said pattern for changing the bending force is determined by using the maximum tracking error time $T_i$ among the differences between the calculated time and observed time when the method is carried out at a plurality of stands.

10. The method for continuously hot-rolling steel pieces according to claim 2, wherein the targeted thickness of the joint at the delivery side of the mill is set to be thicker than the targeted thickness of the sheet in the stationary zones of the preceding and succeeding steel pieces at the delivery side of the mill of at least one stand.

11. The method for continuously hot-rolling steel pieces according to claim 3, wherein the targeted thickness of the joint at the delivery side of the mill is set to be thicker than the targeted thickness of the sheet of the stationary zones of the preceding and succeeding steel pieces at the delivery side of the mill of at least one stand.

12. The method for continuously hot-rolling steel pieces according to claim 10, wherein the method uses a means for calculating one of an on-line and off-line the changing force of a work roll bender controlled by the rolling force variation caused by increasing the thickness of the joint and its neighboring sections and the shape variation of the sheet caused by the force variation wherein the bending force is changed at the thickness-increased portion of the joint and its neighboring sections compared with the stationary zone, in response to the changing bending force.

13. The method for continuously hot-rolling steel pieces according to claim 11, wherein the method uses a means for calculating one of an on-line and off-line the changing force of a work roll bender controlled by the rolling force variation caused by increasing the thickness of the joint and its neighboring sections and the shape variation of the sheet caused by the force variation wherein the bending force is changed at the thickness-increased portion of the joint and its neighboring sections compared with the stationary zone, in response to the changing bending force.

14. The method for continuously hot-rolling steel pieces according to claim 10, wherein the rolling mill is provided with a work roll bender and an actuator for controlling a shape of the strip wherein an amount of control provided by said actuator is changed before changing the bending force at the predetermined section in response to a predetermined changing bending force wherein the bending force to be changed is set within the ability of the bender at the thickness-changing section by preliminarily changing the bending force in synchronism with the change of the controlling amount of the actuator so as to avoid a shape change of the rolled material at a starting and an end point of the change.

15. The method for continuously hot-rolling steel pieces according to claim 11, wherein the rolling mill is provided with a work roll bender and an actuator for controlling a shape of the strip wherein an amount of control provided by said actuator is changed before changing the bending force at the predetermined section in response to a predetermined changing bending force wherein the bending force to be changed is set within the ability of the bender at the thickness-changing section by preliminarily changing the bending force in synchronism with the change of the controlling amount of the actuator so as to avoid a shape change of the rolled material at a starting and an end point of the change.

16. The method for continuously hot-rolling steel pieces according to claim 10, wherein the rolling mill is provided with a work roll bender and a roll cross device that is capable of changing a roll cross angle during a run, said roll cross angle changed before changing the bending force at the predetermined section in response to a predetermined changing bending force wherein the bending force to be changed is set within the ability of the bender at the thickness-changing section by preliminarily changing the bending force in synchronism with the change of the cross angle so as to avoid a shape change of the rolled material at a starting and an end point of the change of the cross angle.

17. The method for continuously hot-rolling steel pieces according to claim 11, wherein the rolling mill is provided with a work roll bender and a roll cross device that is capable of changing a roll cross angle during a run, said roll cross angle changed before changing the bending force at the predetermined section in response to a predetermined changing bending force wherein the bending force to be changed is set within the ability of the bender at the thickness-changing section by preliminarily changing the bending force in synchronism with the change of the cross angle so as to avoid a shape change of the rolled material at a starting and an end point of the change of the cross angle.

18. The method for continuously hot-rolling steel pieces according to claim 10, wherein the rolling mill is provided with a work roll bender and a roll shift device capable of shifting rolls wherein the amount of the roll shift during a run is changed before changing the bending force at the predetermined section in response to a predetermined changing bending force and wherein the bending force to be changed is set at within the ability of the bender at the thickness-changing section by preliminarily changing the bending force in synchronism with the change of the amount of the shift so as to avoid a shape change of the rolled material at a starting and an end point of the change of the amount of the shift.

19. The method for continuously hot-rolling steel pieces according to claim 11, wherein the rolling mill is provided with a work roll bender and a roll shift device capable of shifting rolls wherein the amount of the roll shift during a run is changed before changing the bending force at the predetermined section in response to a predetermined changing bending force and wherein the bending force to be changed is set at within the ability of the bender at the thickness-changing section by preliminarily changing the bending force in synchronism with the change of the amount of the shift so as to avoid a shape change of the rolled material at a starting and an end point of the change of the amount of the shift.

* * * * *